United States Patent [19]

Oda et al.

[11] Patent Number: 5,027,152

[45] Date of Patent: Jun. 25, 1991

[54] IMAGE-FORMING MACHINE HAVING A PROCESS UNIT DETACHABLY MOUNTABLE ON A MOVABLE SUPPORTING AND GUIDING MEANS

[75] Inventors: Kenji Oda, Toyonaka; Makoto Eki, Osaka; Eiji Tsutsui, Sanda; Masanobu Maeshima, Sakai, all of Japan

[73] Assignee: Mita Industrial Co., Ltd., Japan

[21] Appl. No.: 542,031

[22] Filed: Jun. 22, 1990

[30] Foreign Application Priority Data

| | | | |
|---|---|---|---|
| June 27, 1989 | [JP] | Japan | 64-164,845 |
| June 29, 1989 | [JP] | Japan | 64-167,329 |
| Jul. 7, 1989 | [JP] | Japan | 64-176,916 |
| Jul. 14, 1989 | [JP] | Japan | 64-183,153 |
| Aug. 31, 1989 | [JP] | Japan | 64-226,502 |

[51] Int. Cl.[5] ..... G03G 15/00

[52] U.S. Cl. ..... 355/200; 355/210

[58] Field of Search ..... 355/200, 210, 211, 260, 355/245

[56] References Cited

U.S. PATENT DOCUMENTS

| | | | |
|---|---|---|---|
| 4,634,264 | 1/1987 | Takahashi | 355/200 |
| 4,702,587 | 10/1987 | Miyoshi | 355/200 |
| 4,873,548 | 10/1989 | Kobayashi et al. | 355/200 |
| 4,876,572 | 10/1989 | Nagatsuna | 355/210 |

FOREIGN PATENT DOCUMENTS

| | | | |
|---|---|---|---|
| 0232064 | 8/1987 | European Pat. Off. | 355/210 |
| 0052887 | 3/1985 | Japan | 355/200 |
| 0140264 | 7/1985 | Japan | 355/210 |
| 0165766 | 7/1986 | Japan | 355/200 |
| 0261662 | 10/1989 | Japan | 355/210 |

*Primary Examiner*—Arthur T. Grimley
*Assistant Examiner*—William J. Royer
*Attorney, Agent, or Firm*—Beveridge, DeGrandi & Weilacher

[57] ABSTRACT

An image-forming machine including a main body of the machine having a lower housing and an upper housing mounted on the lower housing pivotably between an open position and a closed position, and a process unit detachably mounted on the lower housing on the main body. The lower housing has a supporting-guiding device mounted pivotably between an elevated position and a lowered position, a holding device pivotably mounted between a holding position at which the supporting-guiding device is held at the elevated position and a release position at which the supporting-guiding device is permitted to move to the lowered position, and a biasing position for elastically biasing the holding device at the holding position. The process unit has a first unit and a second unit. The supporting-guiding device positioned at the elevated position can be mounted on and detached from the first unit. The second unit is separably combined with the first unit. The first unit includes a developing device, and the second unit includes a rotating drum having a photosensitive member disposed on the surface.

52 Claims, 11 Drawing Sheets

IMAGE-FORMING MACHINE HAVING A PROCESS UNIT DETACHABLY MOUNTABLE ON A MOVABLE SUPPORTING AND GUIDING MEANS

FIELD OF THE INVENTION

This invention relates to an image-forming machine such as a laser beam printer or an electrostatic copying machine. More specifically, it relates to an image-forming machine comprising a main body of the machine and a process unit detachably mounted on the main body.

DESCRIPTION OF THE PRIOR ART

It is well known to those skilled in the art that particularly in small-sized image-forming machines, the type having a process unit detachably mounted on the main body of the machine is gaining widespread acceptance. The process unit includes a rotating drum having a photosensitive member disposed on its surface, a developing device and a cleaning device.

U.S. Pat. application Ser. No. 07/430,339 and European Pat. application No. 89120900.9, having the same assignee as the present one disclose an image-forming machine of the type in which the main body is comprised of a lower housing and an upper housing mounted on the lower housing so as to be free to pivot between an open position and a closed position, and a process unit is detachably mounted on the lower housing of the main body of the machine. The process unit is constructed of a first unit and a second unit separably combined with each other. The first unit comprises a first frame member, a developing device mounted on the frame member so that it is free to move over a predetermined range, and an elastic biasing means for elastically biasing the developing device in a predetermined direction. The second unit comprises a second frame member, a rotating drum mounted rotatably on the second frame member and a cleaning device mounted on the second frame member. On the other hand, the lower housing of the main body of the machine has provided therein a supporting-guiding means mounted pivotably between an elevated position and a lowered position, a holding means mounted so that it is free to pivot between a holding position at which it holds the supporting-guiding means at the elevated position and a release position at which it permits the supporting-guiding means to move to the lowered position, and an elastic biasing means for elastically biasing the holding means at the holding position.

The process unit is mounted on the main body of the machine in the following manner. First, the upper housing of the main body of the machine is pivoted to the open position, and the supporting-guiding means is brought to the elevated position. The supporting-guiding means is held at the elevated position by the holding means which is biased at the holding position by the elastic biasing means. Thereafter, the first unit of the process unit is mounted on the supporting-guiding means. When the first unit is mounted in the determined position, a projecting piece formed in the first unit acts on the holding member to move the holding member from the holding position toward the release position against the biasing action of the elastic biasing means. Hence, the supporting-guiding means on which the first unit is mounted is pivoted to the lowered position. Then, the second unit is placed on a stand disposed within the lower housing, and the supporting-guiding means is further elevated beyond the elevated position to elevate the supporting-guiding member and the first unit amounted thereon. Thereafter, the second unit on the stand is also elevated to position the first unit and the second unit in a predetermined relation and the first unit and the second unit are combined. When the first unit is combined with the second unit, more specifically when the second frame member of the second unit is engaged with the first frame member of the first unit, the biasing action of the biasing elastic means of the first unit causes a specific site of the developing device (namely, rotatable distance-setting rollers disposed in the widthwise direction at intervals) to come into contact with both side portions of the rotating drum. As a result, the rotating drum and the developing device are positioned in a predetermined position. When the supporting-guiding means on which is positioned a process unit comprising a combination of the first unit and the second unit is pivoted to the lowered position, the process unit is positioned at a predetermined actuating position within the lower housing.

Although the image-forming machine of the above-described form has various technical advantages, it is still not entirely satisfactory, and this conventional image-forming machine still has some problems to be solved.

For example, (1) when the first unit is mounted in a predetermined position on the supporting guiding means, the holding means moves toward the release position from the holding position, and therefore, the supporting guiding means is not held at the elevated position.

(2) When the process unit is to be mounted on, or detached from, the main body of the machine, the upper housing is brought to the opening position and then it is necessary to elevate the supporting-guiding means without fail by hand.

Accordingly, the operation of mounting and detaching the process unit on and from the main body of the machine is not sufficiently easy.

Furthermore, when the second unit is engaged with the first unit, it is necessary to elevate by hand both the supporting-guiding means having the first unit mounted thereon and the second unit. Hence, the operation of combining the second unit with first unit is not sufficiently easy.

When the second unit is to be combined with the first unit, it is necessary to position the first unit and the second unit in a predetermined relation against the biasing action of the elastic biasing means which elastically biases the developing device in a predetermined direction in the first unit. In view of this, too, the operation of combining the second unit with the first unit is not sufficiently easy.

Furthermore, in the operation of assembling the first unit itself of the process unit, an extension spring member such as a coil spring must be stretched taut in a relatively narrow distance between the first frame member and the developing device, and the operation of stretching such a extension spring member taut is considerably difficult.

SUMMARY OF THE INVENTION

A first object of this invention is to improve the image-forming machine so that the operation of mounting a process unit on the main body of the machine and detaching it from the main body sufficiently easily.

A second object of this invention is to improve the image-forming machine so that the operation of mounting the first unit of the process unit on the main body of the machine and combining the second unit with the first unit of the process unit can be performed sufficiently easily.

A third object of this invention is to improve the image-forming machine so that an extension spring member can be stretched taut sufficiently easily between the first frame member and the developing device in the first unit of the process unit.

A fourth object of this invention is to improve the image-forming machine so that even when the process unit is mounted on the supporting-guiding means disposed in the lower housing, the holding means kept at the holding position at which it holds the supporting-guiding means is not moved from the holding position, and when the upper housing is pivoted to the closing position from the opening position, the holding means is moved to the release position at which the supporting guiding means is moved to the lowered position, and thus, the mounting of the process unit on the lower housing and its detachment therefrom can be greatly made easy.

A fifth object of this invention is to provide an improved image-forming machine in which when the upper housing is pivoted to the opening position, the supporting guiding means is moved to the elevated position in synchronism, and the mounting of the process unit on the lower housing and its detachment therefrom can be greatly made easy.

A sixth object of this invention is to provide an improved image-forming machine in which when the first unit of the process unit is mounted on the supporting-guiding means held at the elevated position and the second unit of the process unit is placed on the stand, the first unit and the second unit are positioned in a predetermined relation, and then when the second unit is moved toward the first unit, the second unit can be combined with the first unit, and consequently, the first unit and the second unit can be combined in the process unit greatly easily.

A seventh object of this invention is to provide an improved image-forming machine in which at the time of combining the second unit with the first unit in the process unit, the developing device in the first unit is forced to a predetermined position against the biasing action of the elastic biasing means in the first unit, and consequently, the combination of the first unit and the second unit in the process unit is greatly made easy; and on the other hand, when the process unit is held at a predetermined actuation position, a specified site of the developing device of the first unit are kept in contact with the both side portions of the rotating drum of the second unit by the biasing action of the elastic biasing means, and consequently, the rotating drum and the developing device are positioned in a predetermined relation.

An eighth object of this invention is to provide an improved image-forming machine in which in the first unit of the process unit, a mounting member mounted on the first frame member so as to be free to move between a spring mounting position and an actuation position is provided, and when the spring mounting member is held at the spring mounted position and an extension spring is mounted between the spring mounting member and the developing device and thereafter, the spring mounting member is moved to the actuation position to elongate the extension spring in the actuating state, the spring mounting member can be fixed at the actuation position, and thus, the operation of assembling the first unit itself in the process unit can be greatly made easy.

In the upper housing of the main body of the image-forming machine of this invention, a forced moving mean is disposed which while the upper housing being pivoted from the opening position to the closed position, acts on the holding means to move the holding means from the holding position to the release position. An interlocing means is interposed between the upper housing and the supporting-guiding means which when the upper housing is pivoted from the closed position to the opening position, correspondingly moves the supporting guiding means from the lowered position to the elevated position. When the first unit of the process unit is mounted on the supporting-guiding means held at the elevated position and the second unit of the process unit is mounted on the stand, a first engaging means disposed in the first unit and a second engaging means disposed in the second unit are positioned in a predetermined relation. A forcing means which selectively acts on the developing device is also provided. When the process unit is mounted on the supporting-guiding means existing at the elevated position, the forcing means forces the developing means to a predetermined position against the biasing action of the elastic biasing means, and when the supporting guiding means is moved to the lowered position, the forcing means no longer acts on the developing device. A spring mounting member is mounted on the first frame member in the first unit of the process unit so that it is free to move between the spring mounting position and the actuating position. The spring mounting member can be fixed at the actuation position.

Other objects of this invention and the technical advantages of the invention will become apparent from the following detailed description made with reference to the accompanying drawings.

DETAILED DESCRIPTION OF THE PREFERRED EMBODIMENTS

One specific embodiment of the image-forming machine of the invention will be described in detail with reference to the accompanying drawings.

Outline of Laser Beam Printer as a Whole

Figure 1:
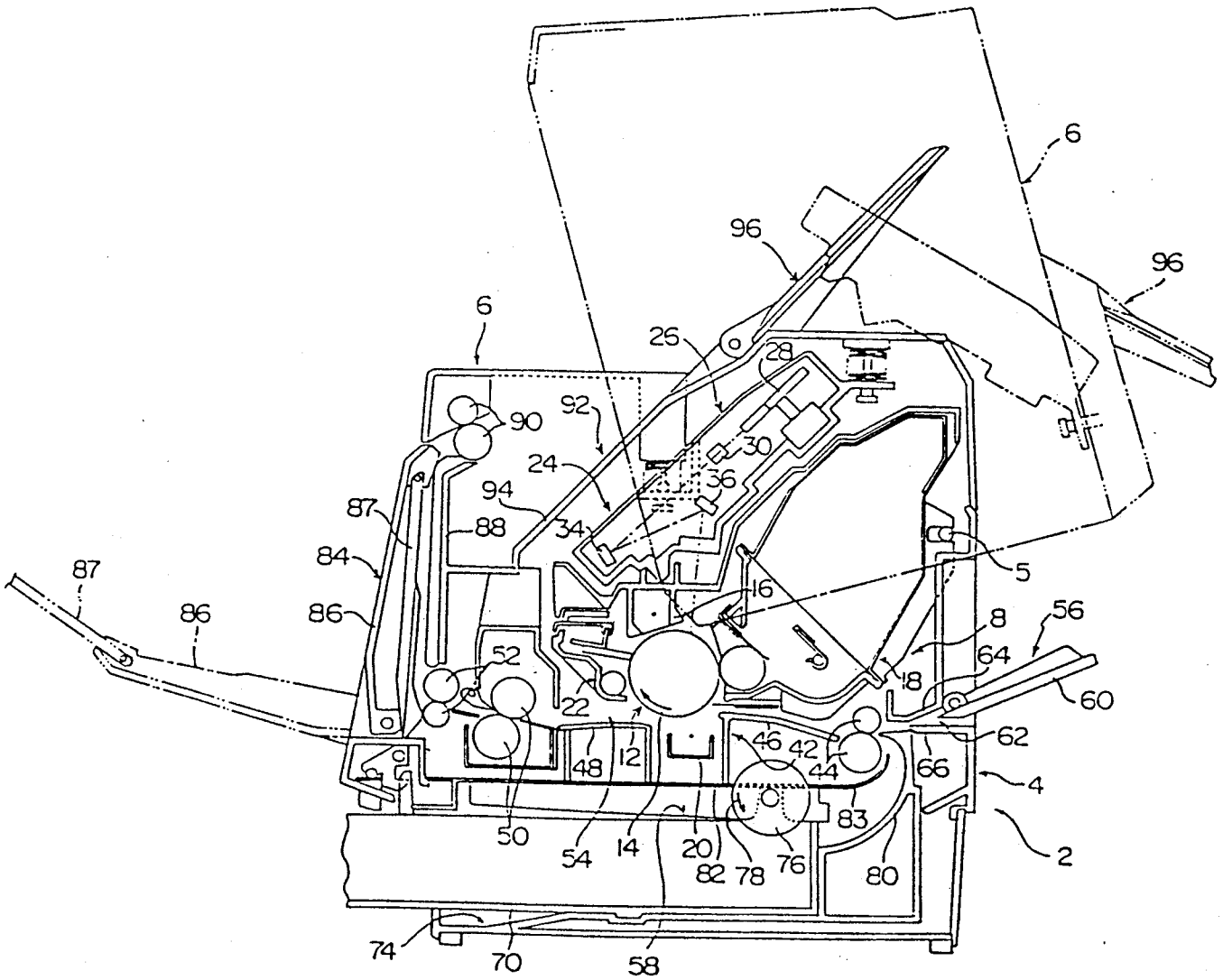
FIG. 1 is a simplified sectional view of a laser beam printer as one example of an image-forming machine constructed in accordance with the present invention.

FIG. 1 shows one embodiment of the laser beam printer as one example of the image-forming machine of the invention. The laser beam printer illustrated in FIG. 1 has a main body shown generally at 2. The main body 2 includes a lower housing 4 and an upper openable-closable housing 6 mounted for free opening and closing on the lower housing 4 via a shaft 5 extending in a direction perpendicular to the sheet surface in FIG. 1 and constituting a pivot axis. The upper housing 6 is free to pivot between a closed position shown by a solid line in FIG. 1 and an open position shown by a two-dot chain line in FIG. 1.

A process unit 8 is disposed nearly centrally in the main body 2, and is detachably mounted on the main body 2 as described below. The process unit 8 is provided with a rotating drum 12 constituting an image bearing means, and an electrostatographic material is disposed on the peripheral surface of the rotating drum 12. Around the rotating drum 12 to be rotated in the direction shown by an arrow 14 are disposed a charging corona discharger 16, a developing device 18, a transfer corona discharger 20 and a cleaning device 22. The rotating drum 12, the corona discharger 16, the developing device 18 and the cleaning device 22 constitute the process unit 8 which will be described in greater detail hereinafter.

An optical unit 24 is provided in the upper portion of the inside of the main body 2, more specifically above the process unit 8. The optical unit 24 includes a box-like unit housing 26 which is mounted on the inside surface of the upper housing 6. Within the housing 26 are disposed a laser beam source (not shown), a rotating polygon mirror 28 to be revolved in a predetermined direction, an image-forming lens 30, a first reflecting mirror 34 and a second reflecting mirror 36. The laser beam source (not shown) irradiates a laser beam based on, for example, image information outputted from a computer toward the rotating polygon mirror 28. The laser beam reflected from the rotating polygon mirror 28 reaches the first reflecting mirror 34 via the image-forming lens 30 as shown by a one-dot chain line in FIG. 1. It is reflected by the first reflecting mirror 34 and the second reflecting mirror 36 and then projected onto the surface of the rotating drum 12.

In the lower portion of the inside of the main body 2, specifically below the process unit 8, is disposed a transfer mechanism shown generally at 42. The transfer mechanism 42 includes a transfer roller pair 44, a guide plate 46, a guide plate 48, a fixing roller pair 50 and a first discharge roller pair 52 which define a transfer passage 54 for transferring a sheet material such as a recording sheet. In the illustrated embodiment, the upstream end of the transfer passage 54 is bifurcated. One branch extends to the right in a straight line, and a hand-insertion feed means 56 is provided at its upstream end. The other branch curves and extends downwardly, and at its upstream end (more specifically, below the transfer mechanism 42 and at the bottom portion of the main body 2), an automatic feed means 58 is provided. The hand-insertion feed means 56 is provided with a table 60 which is free to pivot between a feed position shown in FIG. 1 and a storage position (not shown) displaced upwardly, and when the hand-insertion feed means 56 is used, the table 60 is held at the feed position. When a sheet material is positioned on the table 60 and inserted through an opening 62 formed in the right surface of the main body 2, the sheet material advances between the under surface of a guide wall 64 and the upper surface of a guide wall 66 of the lower housing 4 and conducted to the transfer roller pair 44. The automatic feed means 58 includes a cassette 70 for loading a stack of sheet materials. The cassette 70 is detachably loaded into a cassette-receiving section 74 defined in the bottom portion of the main body 2 through an opening formed in the left surface of the main body 2. A feed roller 76 is disposed above the cassette-receiving section 74. When the feed roller 76 is revolved in the direction shown by an arrow 78, the sheet material is delivered from the cassette 70 by the action of the feed roller 76. The delivered sheet material passes through a guide wall 80 of the lower housing 4 and a guiding portion 83 provided in a partitioning wall 82, and is conducted to the conveyor roller pair 44.

The downstream end of the transfer passage 54 is also bifurcated, and in regard to this, an opening-closing portion 84 of the upper housing 6 is adapted to be selectively held at a first position shown by a two-dot chain line in FIG. 1 and a second position shown by a solid line in FIG. 1. When the opening-closing portion 84 composed of a first member 86 and a second portion 87 pivotally linked to the first member 86 is at the first position (at which time the second member 87 is held in a positional relationship projecting from the first member 86), the sheet material sent from the first discharge roller pair 52 is discharged out of the main body 2 and received in the inside surface (the upper surface shown by the two-dot chain line) of the opening-closing portion 84. On the other hand, when the opening-closing portion 84 is at the second position (at which time the second member 8 is maintained in a positional relationship overlapping the first member 86), the sheet material sent from the first discharge roller pair 52 passes between the opening-closing portion 84 in the upper housing 6 and an upstanding wall portion 88 and is conveyed upwardly, and by the action of a second discharge roller pair 90, the sheet material is discharged into a receiving portion 92 defined in the upper surface of the main body 2. The receiving portion 92 is defined by an inclined upper wall 94 in the upper housing 6. An auxiliary receiving member 96 is mounted on the upper end portion of the inclined upper wall 94 for free pivotal movement between a receiving position shown in FIG. 1 and a storage position (not shown).

The operation of the laser beam printer will be described in a general manner.

While the rotating drum 12 is rotated in the direction of arrow 14, the charging corona discharger 16 charges the photosensitive material of the rotating drum 12, then a laser beam from the laser beam source (not shown) of the optical unit 24 is projected onto the photosensitive member, and consequently, a latent electrostatic image corresponding to the image information is formed on the surface of the photosensitive material. By the action of the developing device 18, a toner is applied to the latent electrostatic image on the photosensitive member. Thereafter, a sheet material such as a recording sheet fed to the transfer passage from the hand-insertion feed means 56 or the automatic feed means 58 is brought into contact with the photosensitive member, and by the action of the transfer corona discharger 20, the toner image on the photosensitive member is transferred to the sheet material. The sheet material having the toner image transferred thereto is peeled from the rotating drum 12 and conveyed to the fixing roller pair 50, and by the action of the fixing roller pair 50, the toner image is fixed to the surface of the sheet material. The sheet material having the toner image fixed thereto is conveyed by the first discharge roller pair 52 and discharged onto the opening-closing portion 84 when the opening-closing portion 84 is at the first position. It is seen from FIG. 1 that when the sheet material is discharged onto the opening-closing portion 84, that surface of the sheet material on which the image is formed is directed upwards. On the other hand, when the opening-closing portion 84 is at the second position, the sheet material conveyed to the discharge roller 52 is further conveyed upwardly and discharged to the receiving portion 92 by the action of the second discharge roller pair 90. As is seen from FIG. 1, when the sheet material is discharged onto the receiving portion 92, that surface of the sheet material on which the image is formed is directed downwards. In the meanwhile, the rotating drum 12 continues to be rotated, and the toner remaining on the surface of the photosensitive member is removed by the action of the cleaning device 22.

Process Unit

Now, with reference to FIGS. 2 to 4 in conjunction with FIG. 1, the process unit 8 will be described in detail.

Figure 2:
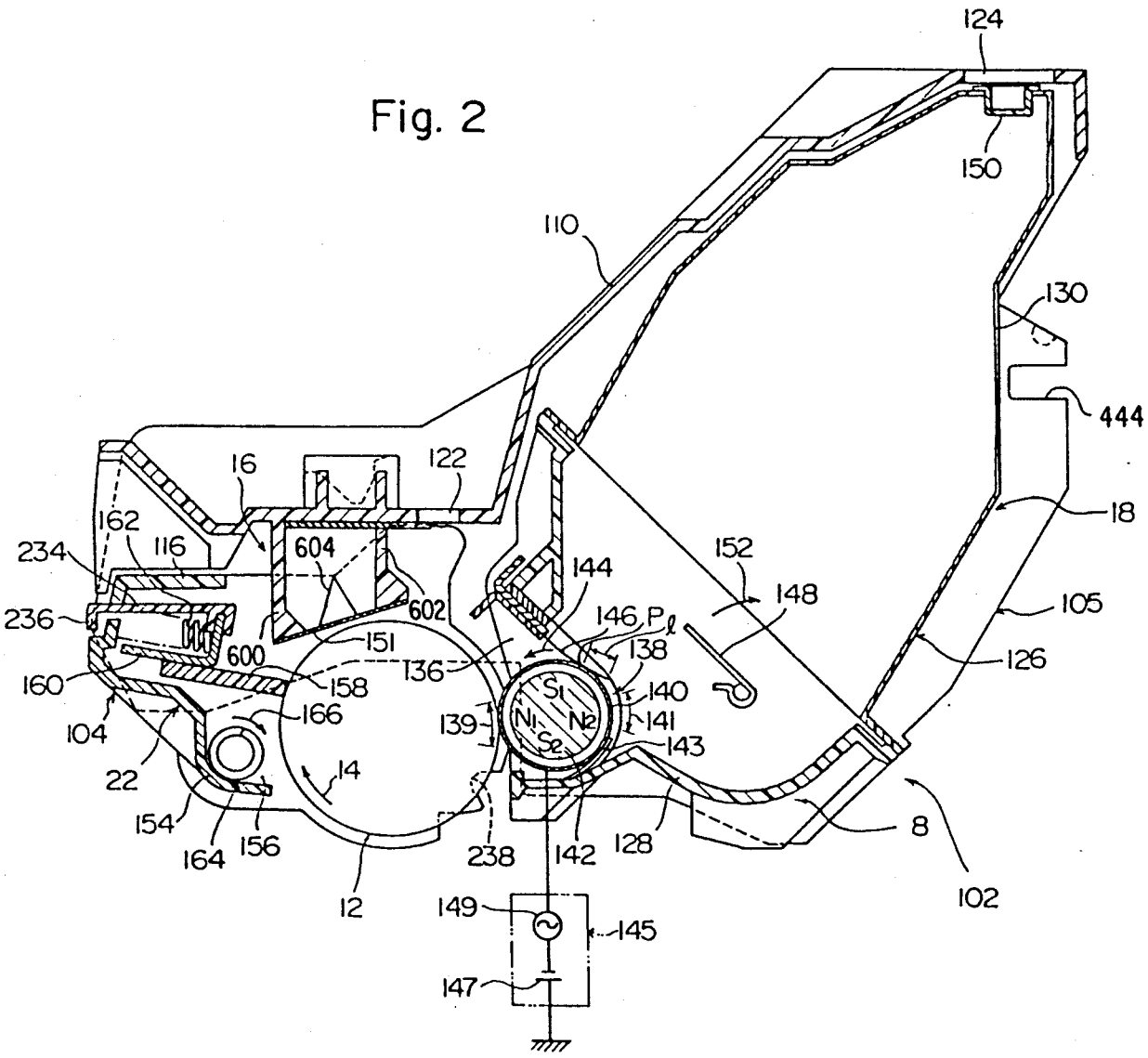
FIG. 2 is a sectional view showing a process unit in the laser beam printer of FIG. 1.
Figure 4:
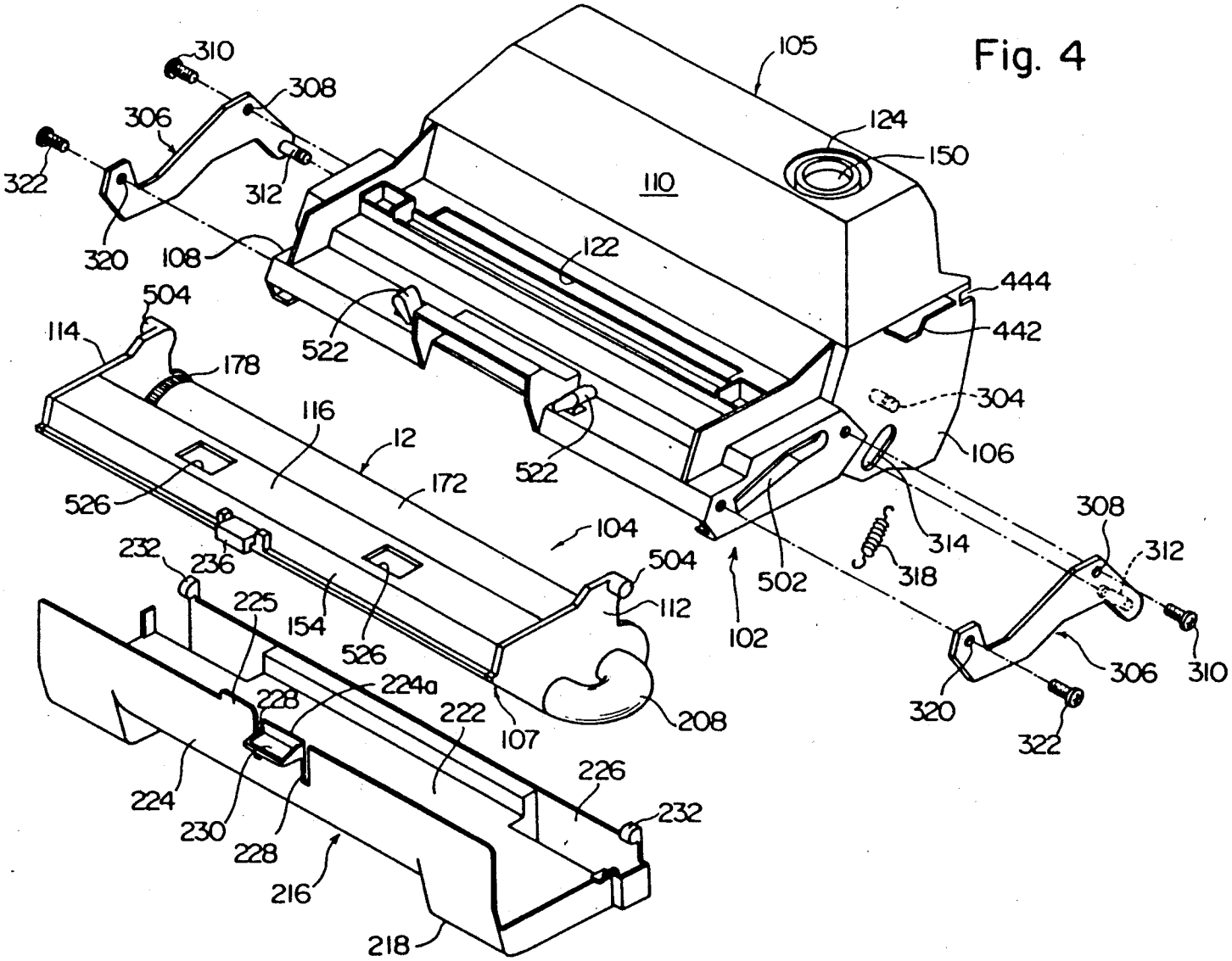
FIG. 4 is an exploded perspective view showing a first unit, a second unit and a cover member in the process unit of FIG. 2.

Mainly with reference to FIGS. 2 and 4, the process unit 8 is comprised of a first unit 102 and a second unit 104 which can be mounted on, and detached from, each other. The charging corona discharger 16 and the developing device 18 are provided in the first unit 102, and the rotating drum 12 and the cleaning device 22, in the second unit 104.

The first unit 102 will first be described in detail. The first unit 102 includes a unit frame 105 having a pair of end walls 106 and 108 spaced from each other in a predetermined direction (the direction perpendicular to the sheet surface in FIGS. 1 and 2, and in the left-right direction in FIG. 3). The upper surface of the unit frame 105 extending across the end walls 106 and 108 is covered with an upper wall 110. The left portion in FIG. 2 of the upper wall 110 extends nearly horizontally, and its right portion is inclined upwardly toward the right in FIG. 2. The developing device 18 is disposed in the right part of the first unit frame 105 between the end walls 106 and 108. The charging corona discharger 16 is disposed in the upper end part of the left portion of the first unit frame 105 between the end walls 106 and 108.

Mainly with reference to FIG. 2, the developing device 18 will be described generally. The developing device 18 is provided with a development& housing 126 comprised of a bottom housing 128 and an upper housing 130 fixed to the upper end of the bottom housing 128. An opening 136 is formed in the left surface (the surface opposing the rotating drum 12) of the bottom housing 128 in FIG. 2, and a magnetic brush mechanism 138 is disposed in the opening 136. The magnetic brush mechanism 138 is comprised of a hollow cylindrical sleeve 140 and a cylindrical permanent magnet 142 disposed within the sleeve 140. The sleeve 140 is formed of a non-magnetic material such as aluminum. The permanent magnet 142 has four magnetic poles, i.e. a developing pole $N_1$ corresponding to a development zone 139, a supply pole $N_2$ corresponding to a supply zone 141 (a zone opposite to the development zone 139). and conveying poles $S_1$ and $S_2$ between the supply pole $N_2$ and the development pole $N_1$. The supply pole $N_2$ and the development pole $N_1$ are N poles, and the conveying poles $S_1$ and $S_2$ are S poles.

An agitating member 148 is disposed at the bottom portion of the development housing 126. A blade 146 is disposed above the magnetic brush mechanism 138. The base portion of the blade 146 is secured to the upper end portion of the opening 136 of the development housing 126, and its free end portion extends toward the sleeve 140 to the right bottom in FIG. 2 and comes into press contact with the surface of the sleeve 140 in an area between the conveying pole $S_1$ and the supply pole $N_2$. The blade 146 may be formed of a material having elasticity, such as phosphor bronze, and comes into press contact with the surface of the sleeve 140 by its own elastic deformation. The projecting length ($\lambda$) of the blade 146 ranging from a point of contact, P, of the blade 146 with the sleeve 140 to its free end may be about 2 to 6 mm. A leakage preventing member 143 is provided below the magnetic brush mechanism 138. The base portion of the leakage preventing member 143 is fixed to the inside surface of the bottom of the development housing 126, and its free end portion makes contact with the sleeve 140. The leakage preventing member 143 may be formed of a urethane rubber, for example.

The sleeve 140 and the agitation member 148 in the development device are drivingly coupled to a driving source which may be a reversible electric motor (not shown) provided in the lower housing 4. When a latent electrostatic image formed on the photosensitive member is to be developed, the sleeve 140 is rotated in a direction shown by an arrow 144, and the agitation member 148, in a direction shown by an arrow 152. A one-component developer composed only of a magnetic toner, for example, is held in the development housing 126. During the development operation, a development bias voltage is applied to the sleeve 140 of the magnetic brush mechanism 138 by the action of a development bias source 145 which may be comprised of a dc voltage source 147 for applying a dc voltage and an ac voltage source 149 for applying an ac voltage.

In the developing device 18, the agitating member 148 revolving in the direction of arrow 152 supplies the developer existing at the bottom of the development housing 126 toward the magnetic brush mechanism 138 while agitating it. The developer so supplied is magnetically held onto the surface of the sleeve 140 in the supply zone 141 by the action of the supply pole $N_2$ of the permanent magnet 142. The developer so held is conveyed toward the developing zone 139 by the action of the sleeve 140 rotating in the direction of arrow 144, and undergoes the action of the blade 146 between the supply pole $N_2$ and the conveyor pole $S_1$ on the upstream side. The blade 146 acts on the developer held onto the surface of the sleeve 140 and removes the excess of the developer whereby a thin layer of the developer is formed on the surface of the sleeve 140. The developer held by the sleeve 140 is moved further in the direction of arrow 144 and under the action of the conveying pole $S_1$, is fed to the developing zone 139. In the developing zone 139, the corresponding developing pole $N_1$ exists and the developer held by the surface of the sleeve 140 is supplied to the surface of the rotating drum 12 rotating in the direction of arrow 14. As a result, the latent electrostatic image formed on the photosensitive member on the rotating drum 12 is developed to a toner image. The developer which has passed through the developing zone 139 is conveyed in the direction of arrow 144 by the rotation of the sleeve 140, undergoes the action of the conveying pole $S_2$ on the downstream side, and is returned to the development housing 126 after moving below the magnetic brush mechanism 138 and passing between the sleeve 140 and the leakage preventing member 143.

Now, the charging corona discharger 16 will be described generally. The corona discharger 16 is provided with a discharger housing comprised of part of the upper wall 110 of the first unit frame 105 and suspending walls 600 and 602 formed as a unit with the upper wall 110. The first unit frame 105, part of which defines the discharger housing, is formed preferably of a synthetic resin having excellent arc resistance, for example a modified poly(phenylene oxide) or modified poly(-phenylene ethylene). Within the discharger housing, a corona wire 604 is stretched taut, and a mesh metallic member 151 acting as a grid electrode is provided in the opening of the discharger housing. A corona from the corona wire 604 of the charging corona discharger 16 is applied to the rotating drum 12 to impart a charge of a specific polarity to the surface of the photosensitive member of the rotating drum 12. The amount of the charge imparted to the surface of the photosensitive member is controlled by the voltage applied to the metallic member 151.

Having regard to the fact that the charging corona discharger 16 and the developing device 18 are provided in the first unit 102, a slender rectangular opening 122 for exposure is formed in the upper wall 110 of the first unit frame 105, and a circular opening 124 is formed in the right end portion of the upper wall 110. Corresponding to the opening 124, a circular supply opening is formed in the upper surface of the development housing 126 of the developing device 18. A sealing cap 150 is fitted in the supply opening (see FIG. 4, too). Hence, by removing the sealing cap 150, a fresh toner can be supplied to the development housing 126 through the opening 124 in the first unit frame 105 and the opening in the development housing 126.

With reference to FIGS. 2 and 4, the second unit 104 will be described. The second unit 104 includes a second unit frame 107 having a pair of end walls 112 and 114 spaced from each other in the aforesaid predetermined direction (the direction perpendicular to the sheet surface in FIGS. 1 and 2). The upper surface of the second unit frame 107 between the end walls 112 and 114 is covered with an upper wall 116. The rotating drum 12 and the cleaning device 22 are mounted on the second unit frame 107.

Figure 5:
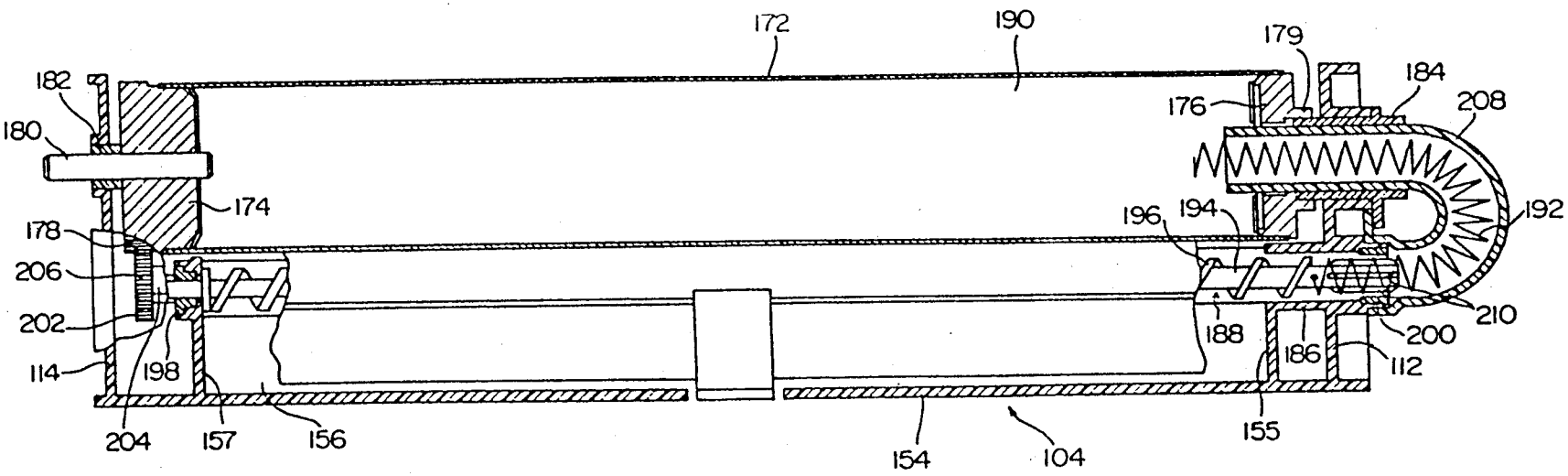
FIG. 5 is a sectional view showing the second unit in the process unit of FIG. 2.

With reference also to FIG. 5, the cleaning device 22 will be described. The cleaning device 22 includes a housing member 154 both ends of which are connected to the end walls 112 and 114 of the second unit frame 107. Inside supporting walls 155 and 157 connected to the inside surface of the housing member 154 are disposed inwardly of the end walls 112 and 114 respectively. Accordingly, as can be seen from FIGS. 2 and 5, the housing member 154 and the inside supporting walls 155 and 157 define a toner recovery chamber 156 for recovering the toner. Above the toner recovery chamber 156 is disposed an elastic blade 158 which may be formed of, for example, a urethane rubber. The base portion of the elastic blade 158 is fixed to an L-shaped supporting plate 160, and its free end portion projects toward the rotating drum 12. It is seen from FIGS. 6 and 7 that the supporting plate 160 is mounted across the inside supporting walls 155 and 157 so as to be free to move toward and away from the rotating drum 12, and is free to move between a receded position shown in FIG. 6 and an advanced position shown in FIG. 7. When the supporting plate 160 is at the receded position, the free end of the elastic blade 158 is away from the rotating drum 12 and is held at a non-operative position at which it does not act on the photosensitive member. On the other hand, when the supporting plate 160 is at the advanced position, the free end portion of the elastic blade 158 comes into press contact with the rotating drum 12 and is held at an operative position at which it acts on the photosensitive member. A biasing spring 162 constituting biasing means is interposed between the supporting plate 160 and the upper end portion of the housing member 154. The biasing spring 162 biases the supporting plate 160 toward the above advanced position, and causes the elastic blade 158 to make press contact with the surface of the rotating drum 12 under a predetermined pressure. A toner transfer means 164 which will be described further hereinbelow is disposed at the bottom of the toner recovery chamber 156.

In the cleaning device 22, the elastic blade 158 acts on the surface of the rotating drum 12 rotating in the direction of arrow 14, and the toner remaining on the surface of the photosensitive member after the transfer is removed by the action of the elastic blade 158. The toner so removed drops into the toner recovery chamber 156 and led to its bottom. The toner collected at the bottom of the recovery chamber 156 is recovered into the space inside the rotating drum 12 by the action of the toner transferring means 164 rotating in the direction shown by an arrow 166.

The rotating drum 12 will be further described. The rotating drum 12 includes a hollow cylindrical drum body 172 which may be formed of, for example, an aluminum alloy. An electrostatographic photosensitive member is disposed on its peripheral surface. End wall members 174 and 176 are fixed to the opposite end portions of the drum body 172. One end portion of the end wall member 174 projects outwardly from one end of the drum body 172, and a large gear 178 is provided on the peripheral surface of this projecting end portion. The gear 178 is drivingly coupled to the driving source (not shown) provided in the lower housing 4. A short rod 180 is fixed to the end wall member 174, and mounted rotatably on the end wall 114 of the second unit frame 107 via a bearing member 182. An annular flange 179 is provided on the outside surface of the other end wall member 176. The flange 179 is rotatably supported on the inside projecting portion of a supporting sleeve 184 fixed to the end wall 112 of the second unit frame 107.

The toner transferring means 164 extends within a hollow space of the rotating drum 12. A sleeve-like wall 186 is provided extending through the inside supporting wall 155 and the end wall 112. The toner transferring means 164 includes a first transferring member 188 disposed at the bottom portion of the toner recovery chamber 156 and a second transferring member 192 for conducting the recovered toner in the toner recovery chamber 156 to the inside space 190 (defined by the end walls 174 and 176 and the drum body 172) of the rotating drum 12. The first transferring member 188 has a shaft portion 194 and a helical member 196 wound about the peripheral surface of the shaft portion 194, and the opposite ends of the shaft portion 194 are rotatably supported via bearings 198 and 200. One end portion of the shaft portion 194 extends toward the inside surface of the end wall 114 through the inside supporting wall 157, and a gear 202 is fixed to this one end portion. The gear 202 is in mesh with the large gear 178 of the rotating drum 12 via a gear 206 rotatably mounted on a short rod 204 provided on the outside surface of the inside supporting wall 157. The toner transferring means 164 further includes a nearly U-shaped hollow cylindrical member 208. One end portion of the hollow cylindrical member 208 is fixed to that part of the sleeve-like wall 186 which projects from the end wall 112, and its other end portion projects into the inside space 190 of the rotating drum 12 through the supporting sleeve 184 and the end wall 176 of the rotating drum 12. The second transferring member 192 is disposed within the hollow cylindrical member 208. The second transferring member 192 may be formed of a flexible helical material such as a coil spring. Its one end portion is connected to the shaft portion 194 of the first transferring member 188, and its other end extends through the hollow cylindrical member 208 and projects slightly into the inside space 190 of the rotating drum 12.

When the rotating drum 12 rotates in the direction of arrow 14, the first transferring member 188 rotates in the direction of arrow 166 (FIG. 2) via the large gear 178 and the gears 206 and 202, and the rotating force of the first transferring member 188 is transmitted to the second transferring member 192. The spent toner recovered in the toner recovery chamber 156 is transferred from left to right in FIG. 5 by the action of the first transferring member 188. Further, by the action of the second transferring member 192, it advances through the hollow cylindrical member 208 and is recovered into the inside space 190 of the rotating drum 12. To ensure transmission of the rotating force from the first transferring member 188 to the second transferring member 192, a plurality of axially extending short beams 210 are provided in the other end portion of the shaft portion 194 in the first transferring member 188. These short beams 210 act to slightly expand one end portion of the second transferring member 192.

In regard to the inside space 190 of the rotating drum 12 in which the used toner is received, the following should also be noted. The rotating drum 12 is so constructed that it can form about 2500 images each in an area having a specific size, for example JIS A4 size, and when about 2500 images are produced, the life of its photosensitive member substantially comes to an end. In this connection, when about 2500 images are produced, the inside space 190 of the rotating drum 12 becomes substantially full of the spent toner recovered during this time. In the specific embodiment, when about 2500 images are produced, about 68 g of the spent toner results. On the other hand, the inside diameter of the drum body 172 of the rotating drum is 27 mm, and the distance between the end walls 174 and 176 is 248 mm. The volume of the inside space 190 is prescribed at 142 $cm^3$. Hence, when about 2500 images are produced about 80% of the entire volume of the inside space 190 is filled with the spent toner, and the spent toner is discarded together with the rotating drum 12. By presetting the volume of the inside space 190 of the rotating drum 12 in this manner, the outside diameter of the rotating drum 12 can be minimized while effectively utilizing the inside space 190 of the rotating drum 12. As a result, the entire machine can be reduced in size.

Figure 7:
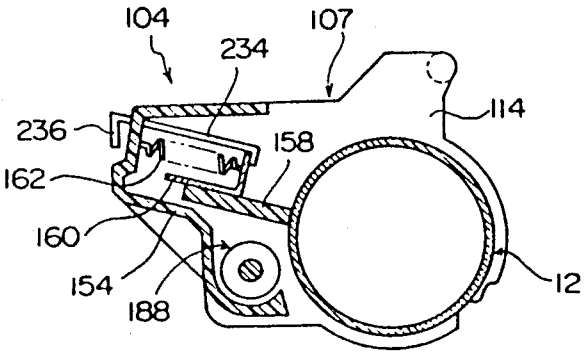
FIG. 7 is a sectional view of the second unit from which the cover means is removed.
Figure 6:
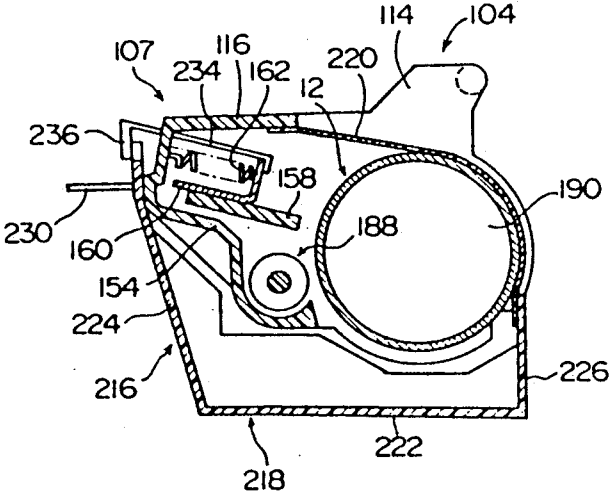
FIG. 6 is a sectional view showing a cover means attached to the second unit.

With reference to FIGS. 6 and 7 together with FIG. 4, a cover means 216 is mounted on the second unit 104 in order to protect the photosensitive member of the rotating drum 12 mounted on the second unit frame 107. The cover means 216 is mounted at the time of producing the second unit 104, and is removed from the second unit 104 at the time of use. The cover means 216 is comprised of a rigid cover member 218 and a flexible protecting sheet 220 (in FIG. 4, the protective sheet is omitted). The cover member 218 may be formed of, for example, a synthetic resin, and as shown in FIG. 6, attached to the lower portion of the second unit 104. The protecting sheet 220 may be formed of paper or a synthetic resin such as a polyester resin, and as shown in FIG. 6, attached to the upper portion of the second unit 104. In the illustrated embodiment, the cover member 218 has a bottom wall 222 and side walls 224 and 226, and a pair of notches 228 are formed at the central portion in the longitudinal direction of the side wall 224. A site **224*a* between the notches 228 is elastically deformable. An operating piece 230 is fixed to the outside surface of the site 224*a*, and an engaging projecting portion 225 is provided adjacent to the site 224*a*. A slightly upwardly projecting engaging portion 232 is provided integrally at both end portions of the other side wall 226**.

A rectangular opening is formed in the upper end portion of the housing member 154 of the second unit 104. An engaging member 234 is fixed to the upper end portion of the supporting plate 160. The free end portion of the engaging member 234 projects outwardly through the opening, and a downwardly extending engaging portion 236 is provided in the projecting end portion of the engaging member 234. The engaging portion 236 may be provided directly in the supporting plate 160. Because of this construction, the cover member 218 can be mounted in position on the second unit 104 by bringing the engaging portion 232 into engagement with a semicircular depressed portion 238 (FIG. 2) defined at the right edge in FIG. 4 of the end walls 112 and 114 of the second unit frame 107 and causing the engaging projection 225 of the side wall 224 to act on the engaging portion 236 of the engaging member 234. Since in this mounted state, the engaging projection 225 of the side wall 224 acts on the engaging portion 236 of the engaging member 234 as shown in FIG. 6, the supporting plate 160 is held at the receded position, and the elastic blade 158 does not act on the surface of the rotating drum 12. Accordingly, the deformation of the elastic blade 158 and the degradation of the photosensitive member are prevented during transportation and storage. Furthermore, in the mounted state, the bottom portion 222 of the cover member 218 covers the under surface of the second unit 104; the side wall 224 covers the left surface in FIG. 6 of the second unit 104; and the side wall 226 covers the lower portion of the right surface in FIG. 6 of the second unit 104. The protecting sheet 220, which may be formed of a black polyester film, is fixed at one end to the inside surface of the upper wall 116 of the second unit frame 107. Its other end covers the space above the rotating drum 12, and is fixed to the upper end portion of the side wall 226 of the cover member 218. The protecting sheet 220 may be fixed detachably by an adhesive, and in the mounted state, covers the open right portion in the upper surface of the second unit 104 and the upper portion of the right surface in FIG. 6 of the second unit 104. Accordingly, where the cover means 216 is mounted in position, the photosensitive member is covered with the cover member 218 and the protecting sheet 220, and is not substantially exposed to the outside. Accordingly, the degradation of the photosensitive member by exterior light can be accurately prevented. The cover means 216 may be detached from the second unit 104 by detaching the engaging projection 225 of the side wall 224 from the engaging portion 236 of the engaging member 234, then pivoting the cover member 218 counterclockwise in FIG. 6 about the engaging portion 232 as a center, and thereafter, while the operating portion 230 is held, pulling the cover member 218 downwardly and detaching one end portion of the protective sheet from the upper wall 116 of the second unit frame 107. As a result, the photosensitive member of the rotating drum 12 is exposed by the detachment of the cover member 218 and the protecting sheet 220 as shown in FIG. 7. Furthermore, this results in the disengagement of the engaging projection 225 of the cover member 218 from the engaging portion 236 of the engaging member 234. Thus, the supporting plate 160 acting as a supporting member is moved to the advanced position (at this time, some clearance exists between the engaging portion 236 of the engaging member 234 and the upper end portion of the housing member 154), and the free end portion of the elastic blade 158 is brought into press contact with the rotating drum 12 by the action of the biasing spring 162. When the rotating drum 12 is detached from the second unit frame 107, the supporting plate 160 is further moved to the right in FIG. 2 by the action of the biasing spring 162. Thus, the engaging portion 236 of the engaging member 234 comes into contact with the upper end portion of the housing member 154, and the above movement of the supporting plate 160 is accurately hampered.

Manner of stretching an extension spring member in the first unit

Figure 8:
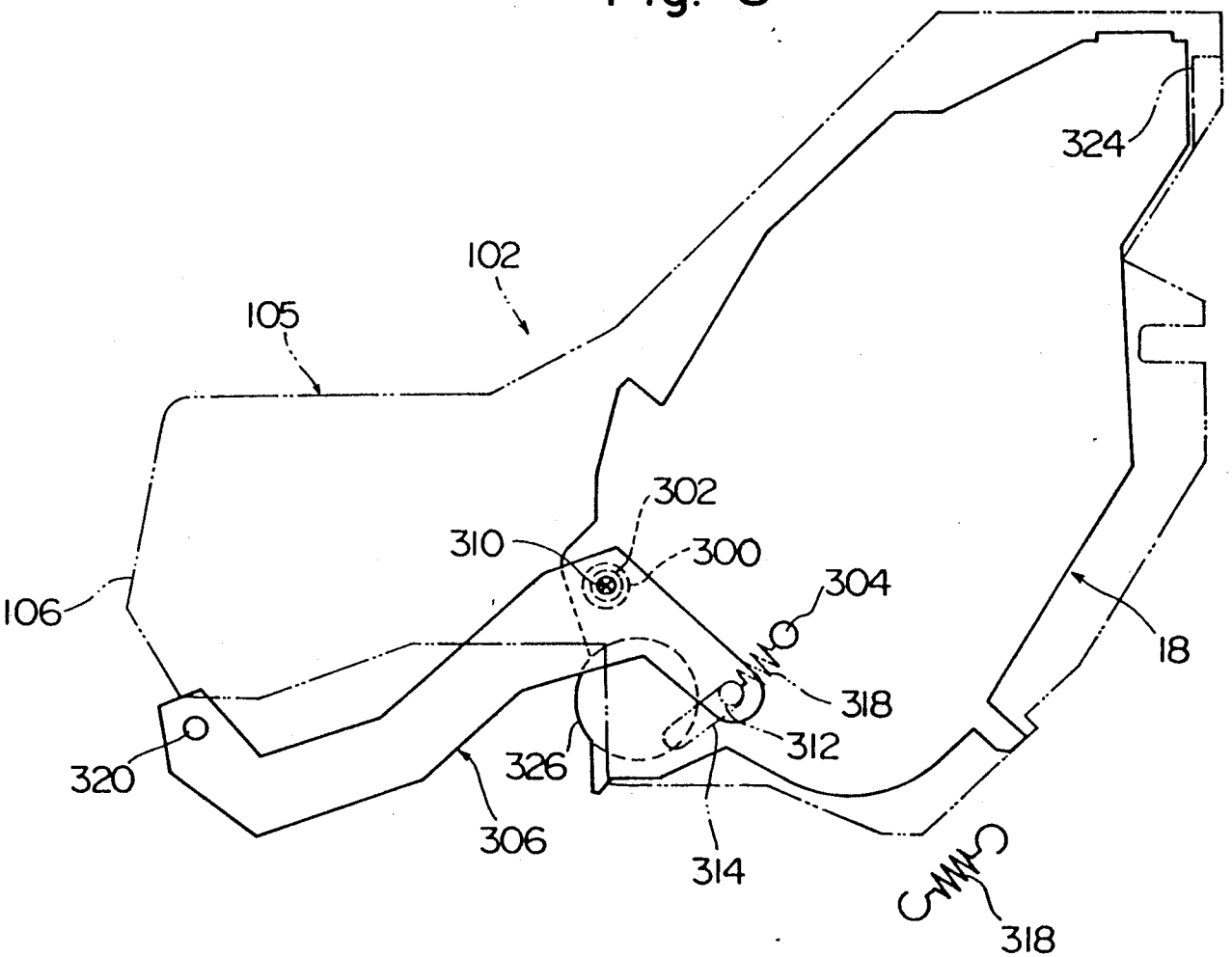
FIGS. 8 and 9 are side elevations for illustrating the manner of stretching an extension spring member in the first unit.
Figure 9:
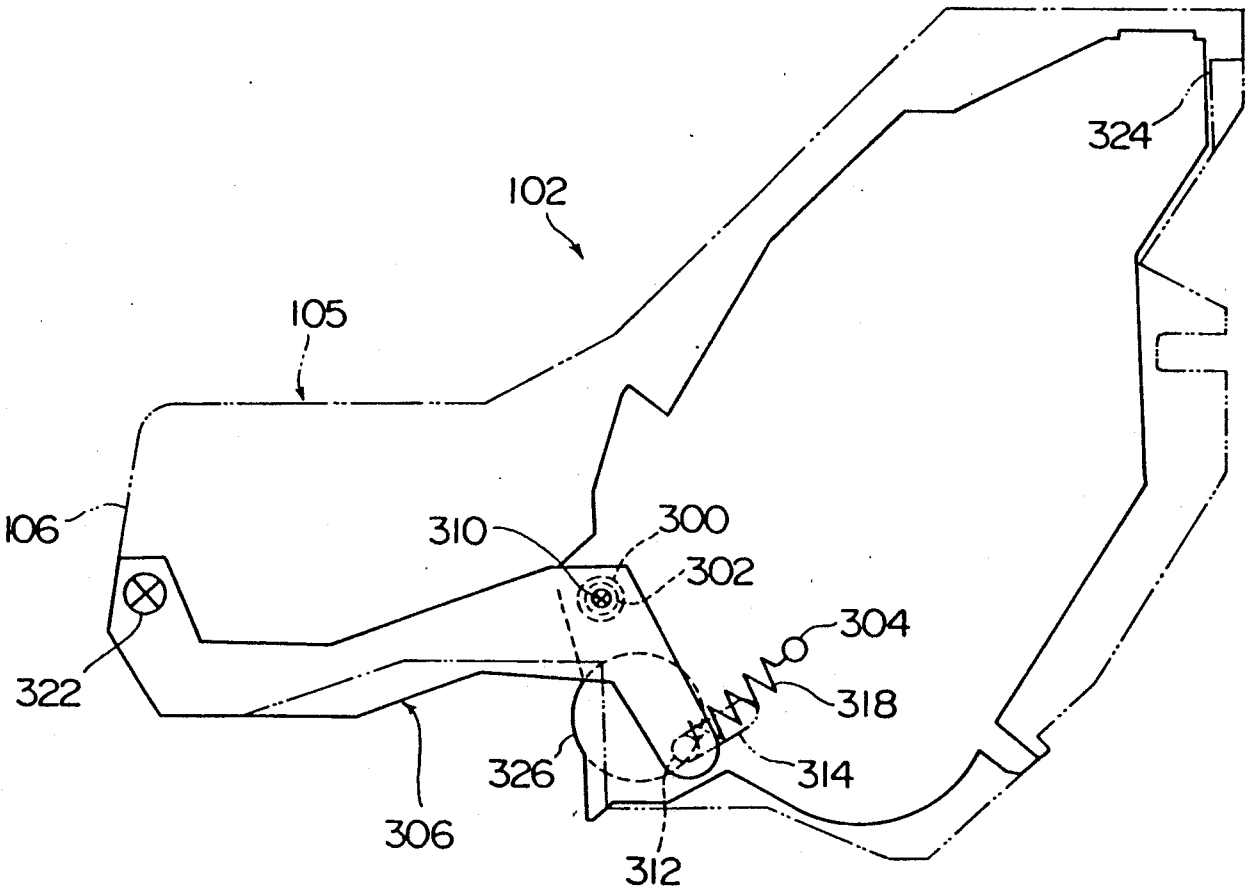

With reference to FIGS. 4, 8 and 9, the first unit 102 of the process unit 8 will be described. A bearing portion 300 protruding inwardly in the width direction (in the direction perpendicular to the sheet surface in FIGS. 8 and 9) is formed in each of the inside surfaces of the end walls 106 and 108 of the unit frame 105. On the other hand, a short rod 302 projecting outwardly in the width direction is formed in the outside surface of both end walls of the developing housing 126 of the developing device 18. The developing device 18 is positioned between both end walls 106 and 108 of the unit frame 105, and the short rod 302 may be inserted rotatably in the bearing portion 300 whereby the developing device 18 can be mounted on the unit frame 105 pivotably around the short rod 302. An anchoring protrusion 304 projecting outwardly in the width direction is formed also in each of both end walls of the developing housing 126. As shown in FIG. 4, a spring engaging member 306 is mounted on the outside of each of the end walls 106 and 108 of &he unit frame 105. A hole 308 is formed in nearly the central part of the spring engaging member 306, and a set screw 310 is screwed on both end walls 106 and 108 through the hole 308. Thus, the spring engaging member 306 is mounted on the end walls 106 and 108 so that it is free to pivot around the set screw 310. An engaging protrusion 312 protruding inwardly in the width direction is formed in one end portion of the spring engaging member 306 (the right end portion in FIGS. 8 and 9). An arcuate slit 314 is formed in each of the end walls 106 and 108 of the unit frame 105, and the engaging protrusion 312 is projected inwardly of the end walls 106 and 108 of unit frame 105 through the slit 314. An extension spring member 318 (which may be an extension coil spring) constituting the development device biasing means is stretched between each of engaging protrusions 304 (constituting a spring engaging site of the developing device 18) and each of engaging protrusions 312 of the spring engaging member 306 (constituting the engaging site of the spring engaging member 306). When disposing the extension spring member 318, each of the spring engaging members 306 is positioned at a spring mounting position at which the engaging protrusion 312 abuts with the upper end of the slit 314, namely is positioned in the position shown in FIG. 8. The free length of the extension spring member 318 conveniently corresponds to the distance between the engaging protrusion 304 and the engaging protrusion 312 when the spring engaging member 306 is positioned at the spring mounting position. In this case, without the need to apply a force to the extension spring member 318 and stretching it, one end of the extension spring member 318 may be engaged with the engaging protrusion 304 and its other end at the engaging protrusion 312. Accordingly, in spite of the fact that the engaging protrusions 304 and 312 are positioned in a relatively narrow region between the end walls 106 and 108 of the unit frame member 105 and the end wall of a development housing 126, the extension spring member 318 can be relatively easily stretched as required between the engaging protrusions 304 and 312. After the extension spring member 318 is stretched between the engaging protrusion 304 and the engaging protrusion 312, a finger is placed on the other end portion (the left end portion in FIGS. 8 and 9), and the spring engaging member 306 is pivoted clockwise in FIGS. 8 and 9 to the actuating position shown in FIG. 9. At this actuating portion, the engaging protrusion 312 of the spring engaging member 306 abuts against the lower end of the slit 314. Then, a set screw 322 is applied to the end walls 106 and 108 of the unit frame 105 through a hole 320 formed at the other end portion of the spring engaging member 306, and thus, the spring engaging member 306 is fixed at an actuating position shown in FIG. 9. When the spring engaging member 306 is pivoted to the actuating position from the spring mounting position, the engaging protrusion 312 of the spring engaging member 306 is removed from the engaging protrusion 304 of the development housing 126, and hence, the extension spring member 318 is stretched. The stretched extension spring member 318 elastically biases the developing device 18 counterclockwise in FIG. 9. Accordingly, the developing device 18, as shown in a simplified manner in FIG. 9, is elastically maintained at a position at which the upper end portion of the development housing 126 abuts against an abutting wall 324 formed at the upper end portion of the end walls 106 and 108 of the unit frame development housing 126. The developing device 18 includes a pair of interval setting rollers 326 (one of which is shown in FIGS. 8 and 9) disposed on both sides of the above development sleeve 140 (FIG. 2). When as will be described later, a process unit 8 constructed by combining a first unit 102 with a second unit 104 is positioned at a predetermined position, the elastic biasing action of the extension spring member 318 causes the interval setting roller 326 of the developing device 18 to be elastically pressed on both end portions (the both end portions are not used for image formation) of the rotating drum 12. Thus, the rotating drum 12 and the developing device 18 (particularly its development sleeve 140) are positioned in a specified relation.

In the illustrated embodiments, the developing device 18 is pivotably mounted on the unit frame 105. If desired, it is possible to mount the developing device 18 on the unit frame 105 in such a way that it is free to move straightforwardly in a specific direction, and to bias the developing device 18 elastically in a specific direction by the extension spring member 318. The spring engaging member 306 may be mounted for free straight forward movement between the spring mounting position and the actuating position instead of mounting it pivotably.

Method of mounting the first unit

Now, with reference to FIGS. 4, 10 and 11, the manner of mounting the first unit 102 of the process unit 8 and its related construction will be described.

Figure 11:
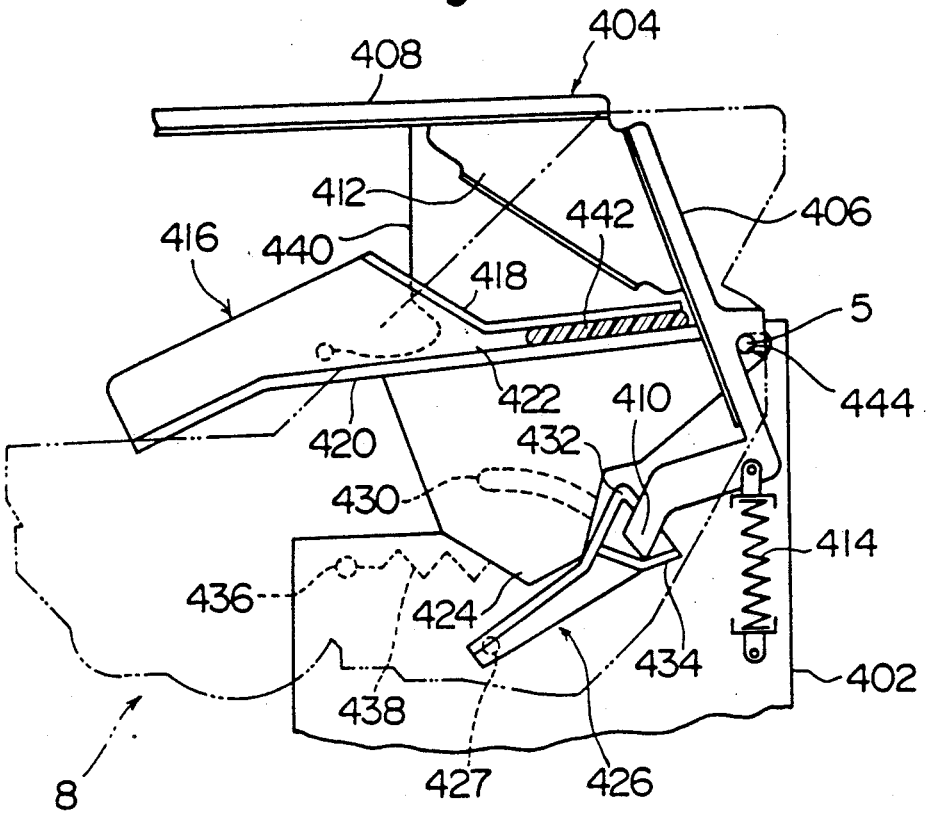
FIGS. 10 and 11 are simplified sectional views for illustrating the manner of mounting the process unit in the image-forming machine in FIG. 1.
Figure 10:
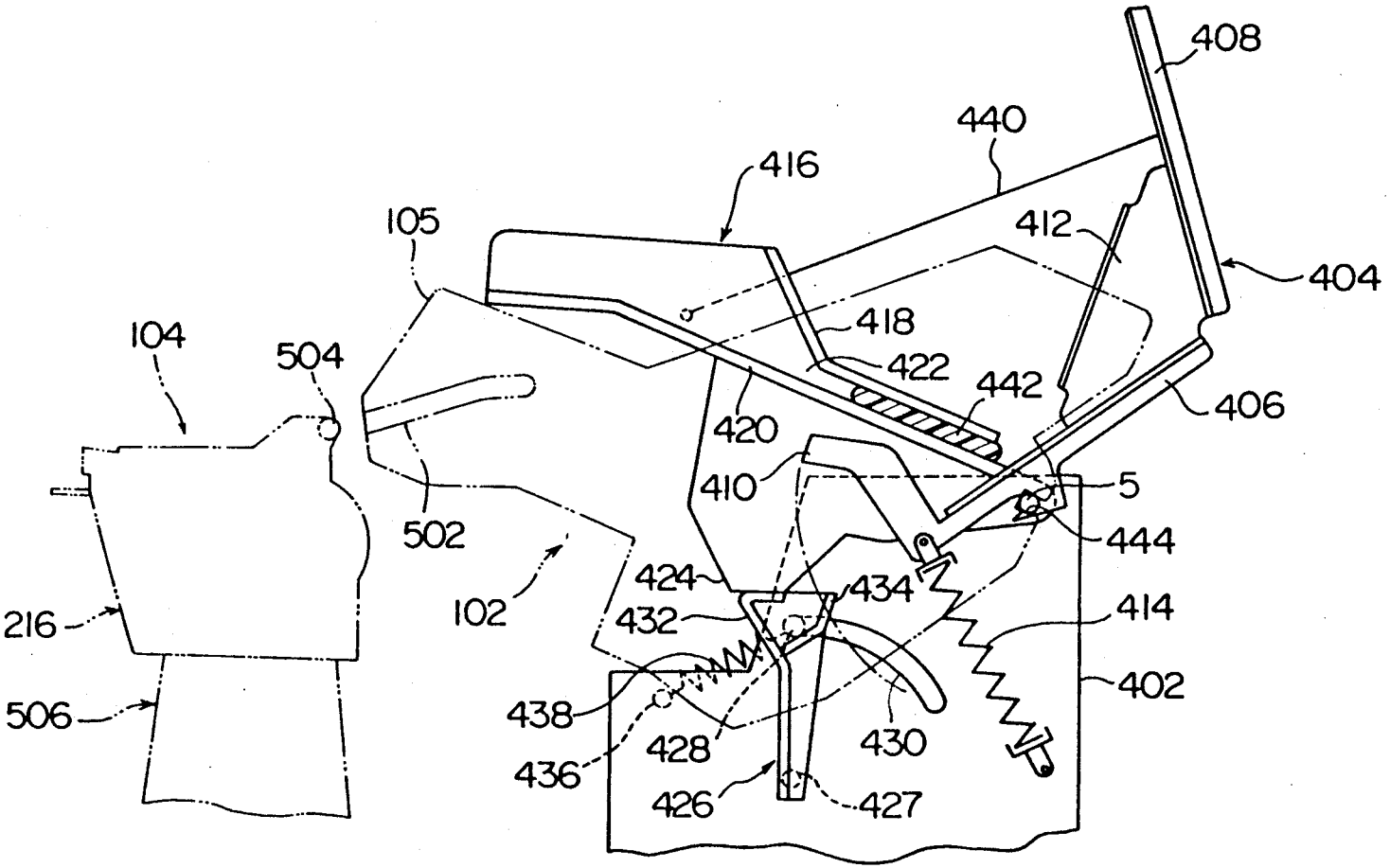

As shown in FIGS. 10 and 11, a pair of upstanding supporting plates 402 (only one of which is depicted in FIGS. 10 and 11) are disposed with a distance in the width direction (a direction perpendicular to the sheet surface in FIGS. 10 and 11) in the lower housing 4. The shaft 5 extending substantially horizontally for mounting the upper housing 6 openably and closably is mounted between the pair of upstanding support plates 402. The upper housing 6 includes a pair of supporting members 404 mounted pivotably on the shaft 5 inwardly of each of the upstanding supporting plates 402. Each of the supporting members 404 has a mounting portion 406 mounted at its nearly intermediate portion pivotably on the shaft 5, a supporting portion 408 extending from one end of the mounting portion 406 nearly at a right angle to it and a forced portion 410 extending from the other end of the mounting portion 406 nearly at a right angle to it. Between the mounting portion 406 and the supporting portion 408 of the supporting member 404 is provided a nearly triangular reinforcing plate portion 412. As will be clearly seen from the following description, the forced portion 410 of the supporting member 404 constitutes a forced moving means. An outer cover, etc. of the upper housing 6 are mounted on the supporting portion 408 of the supporting member 404. The supporting member 404 is pivoted between an open position indicated in FIG. 10 and a closed position shown in FIG. 11, and according to this pivoting of the supporting member 404, the upper housing 6 is pivoted between an open position shown by a two-dot chain line in FIG. 1 and a closed position shown by a solid line in FIG. 1. Between the upstanding supporting plate 402 and the lower housing 4 and the supporting member 404 of the upper housing 6 is interposed an elastic biasing means 414 which may be a compression coil spring. As can be understood from FIG. 11, when the supporting member 404 (and therefore, the upper housing 6) is held at the closed position, the elastic biasing means 414 applies an elastic force to the supporting member 404 at a position slightly to the right of the shaft 5 in FIG. 11, or at a position substantially in alignment with the vertical direction of the shaft 5, and accordingly, the supporting member 404 (and therefore, the upper housing 6) is elastically biased counterclockwise (i.e., at a closed position) in FIG. 11, or is not biased substantially in any direction. However, as will be understood by comparing FIG. 11 with FIG. 10, when the supporting member 404 (and therefore, the upper housing 6) begins to pivot somewhat toward the open position from the closed position, an elastic force is applied to the supporting member 404 in FIG. 10 at a position left of the shaft 5, and therefore, the supporting member 404 (and therefore upper housing 6) is elastically biased clockwise in FIG. 10. When the upper housing 6 is pivoted to the open position shown by a two-dot chain line in FIG. 1, a suitable stop portion (not shown) disposed in the upper housing 6 abuts against a suitable stop portion (not shown) disposed in the lower housing 4, thus hampering pivoting of the upper housing 6 (and therefore, the supporting member 404) beyond the open position.

Again, with reference to FIGS. 10 and 11, a pair of supporting-guiding members 416 spaced from each other in the width direction are also mounted on the shaft 5 of the lower housing 4. As will be apparent from the following description, the pair of supporting-guiding members 416 have a supporting-guiding means to mount the process unit 8 and in detail the first unit 102. Each of the supporting-guiding members 416 has its one end portion (the right end portions in FIGS. 10 and 11) pivotably mounted on the shaft 5 between each of the upstanding supporting plate 402 and each of the supporting members 404, and as will be described below, each of the supporting-guiding members 416 is pivoted between an elevated position shown in FIG. 10 and a lowered position shown in FIG. 11. Guiding protrusions 418 and 420 are formed in each of the inside surfaces of the supporting-guiding members 416. A guiding channel 422 is defined between the guiding protrusions 418 and 420. Upstream of the guiding channel 422, namely the left side portion in FIGS. 10 and 11, has a gradually increasing breadth as it goes upstream. Each of the supporting-guiding members 416 has a downwardly projecting hold portion 424 in its intermediate portion. Having regard to the pair of supporting-guiding members 416, holding members 426 are mounted on each of the inside surface of the upstanding supporting plate 402 of the lower housing 4. Each of the holding members 426 constituting holding means acting on the supporting-guiding member 416 is pivotably mounted at its lower end portion on the upstanding supporting plate 402 via mounting pin 427. A guide protrusion 428 projecting outside of each upper end portion of the holding members 426. Each of the upstanding supporting plate 402 has an arcuate slit 430 formed therein, and a guided projection 428 is inserted into the slit 430. Thus, each of the holding members 426 can be pivoted between a holding position shown in FIG. 10 and a released position shown in FIG. 11. In the holding position shown in FIG. 10, a guided protrusion 428 is positioned at one end (left side in FIG. 10) of the slit 430, and in the released position shown in FIG. 11, the guided protrusion 428 is positioned in the other end of the slit 430 (the right end in FIG. 11). Protrusions 432 and 434 are formed in each of the inside surfaces of the holding members 426. The upper end portion of the protrusion 432 functions as a holding portion, and the upper end portion of the protrusion 434 functions as a forced portion. An outwardly projecting engaging pin 436 is fixed at each of the upstanding supporting plates 402 of the lower housing 4. Between these engaging pin 436 and the guided protrusion 428 is stretched taut a spring member 438 which may be a tension coil spring. The spring member 438 constituting biasing means elastically biases the holding member 426 counterclockwise in FIG. 10, and maintains the holding member 426 at a holding position shown in FIG. 10 elastically. When the holding member 426 is held at the holding position shown in FIG. 10, the upper end portion of the protrusion 432 makes contact with the lower end of the held portion 424 of the supporting-guiding member 416 to maintain the supporting-guiding member 416 at the elevated position shown in FIG. 10. When the holding member 426 is pivoted to the released position shown in FIG. 11 in the manner to be later described, the supporting guiding member 416 is permitted to pivot from the elevated position shown in FIG. 10 to the lowered postion shown in FIG. 11, and the supporting-guiding member 416 is pivoted to the lowered position shown in FIG. 11 by its own weight and by the weight of the process unit 8 mounted thereon. As shown in FIGS. 10 and 11, between each of the supporting portions 408 of the supporting member 404 and each of the supporting-guiding members 416, an interlocking means 440 that can be composed of a flexible wire is interposed. Instead of the flexible wire fixed at one end to the supporting portion 408 of the supporting member 404 and at the other end to the supporting guiding member 416, the interlocking means 440 may be constructed of a suitable linking mechanism.

With reference to FIGS. 10 and 11 and FIG. 1, the interaction of the supporting member 404, the supporting-guiding member 416 and the holding member 426 will be described below. When the upper housing 6 is pivoted to an open position shown by a two-dot chain line in FIG. 1 from a closed position shown by a solid line in FIG. 1 and thus, the supporting member 404 is pivoted from the closed position shown in FIG. 11 to the open position shown in FIG. 10. According to the pivoting of the supporting member 404, the interlocking means 440 pulls the supporting-guiding member 416, and the supporting guiding member 416 is pivoted to the elevated position shown in FIG. 10 from the lowered position shown in FIG. 11. Simultaneously with this, the holding member 426 is pivoted from the release position shown in FIG. 11 to the holding position shown in FIG. 10 by the elastic biasing action of the spring member 438. The upper end portion of the protrusion 432 of the holding member 426 pivoted to the holding position abuts against the held portion 424 of the supporting guiding member 416 pivoted to the elevated position, and thus, the supporting guiding member 416 is accurately held at the elevated position. The supporting member 404 pivoted to the open position shown in FIG. 10 is maintained in the open position by the biasing action of the elastic biasing means 414. Hence, the interlocking means 440 also has the function of holding the supporting guiding member 416 at the elevated position. When the upper housing 6 is pivoted from the open position shown by a two-dot chain line in FIG. 1 to the closed position shown by a solid line in FIG. 1, the forward end of the forced portion 410 of the supporting member 404 draws a locus shown by a one-dot chain line in FIG. 10. As can be easily understood by comparing FIG. 10 with FIG. 11, when the supporting member 404 is pivoted from the open position shown in FIG. 10 to the closed position shown in FIG. 11, the forcing portion 410 of the supporting member 404 interferes with the other end portion of the protrusion 434 of the holding member 426. As a result, the holding member 426 is pivoted from the holding position shown in FIG. 10 to the release position shown in FIG. 11 forcibly. When the supporting member 404 is pivoted to the closed position shown in FIG. 11, the interlocking means 440 which has so far pulled the supporting guiding member 416 to the elevated position is loosened. Hence, the action to hold the supporting guiding member 416 at its elevated position is dissolved, and the supporting guiding member 416 is pivoted from the elevated position shown in FIG. 10 to the lowered position shown in FIG. 11.

With reference to FIG. 4 as well as FIG. 10, in the first unit 102 of the process unit 8, an outwardly projecting guided piece 442 is formed integrally on the outside surfaces of both end walls 106 and 108 of the unit frame 105. Furthermore, an engaging recess 444 is formed at the forward ends (right end in FIG. 10) of the end walls 106 and 108. When the pair of the supporting guiding members 416 are at the elevated position shown in FIG. 10, the first unit 102 can be mounted on or detached from the supporting-guiding member 416. When the first unit 102 is mounted on the supporting-guiding member 416, the first unit 102 is inserted from the left side in FIG. 10 between the pair of the supporting-guiding member 416, and the guided piece 442 formed in the two end walls 106 and 108 of the unit frame 105 is caused to advance into the guiding channel 422 formed on the inside surface of the supporting guiding member 416. When the first unit 102 is moved to the right in FIG. 10 to the position shown in FIG. 10, recesses 444 formed in the forward ends 106 and 108 of the unit frame 105 are into engagement with the shaft 5. Thus, the first unit 102 is prevented from moving to the right in FIG. 10, and positioned at a required position in the supporting guiding member 416. To detach the first unit 102 from the supporting guiding member 416 at the elevated position, the first unit 102 may be moved to the left in FIG. 10.

Manner of mounting the second unit

Now, with reference to FIGS. 3 and 4 together with FIGS. 10 and 12, the manner of mounting the second unit 104 of the process unit 8 and related structures will be described.

Figure 3:
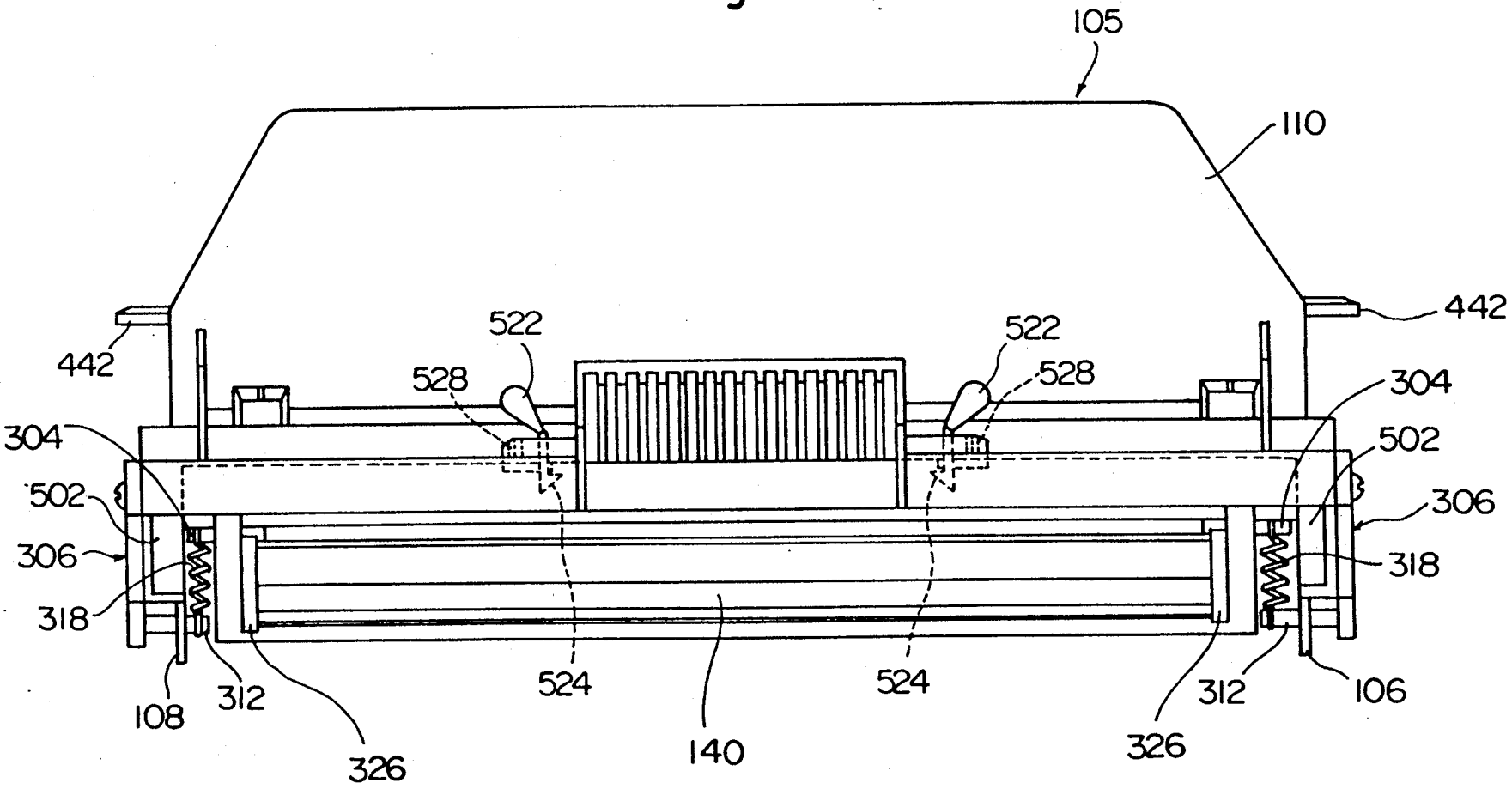
FIG. 3 is a side elevation showing a first unit in the process unit of FIG. 2.

As shown in FIGS. 3,4 and 10, in the first unit 102, a guiding channel 502 existing from left to right in FIG. 10 is formed in each of both end walls 106 and 108 of the unit frame member 105. The upstream end of such guiding channel 502 is opened toward the left in FIG. 10, and its downstream end is closed. The guiding channel 502 is opened also outwardly in the widthwise direction excepting its upstream end. On the other hand, in the second unit 104, a guided protrusion 504 is formed in each of the end walls 112 and 114 of the unit frame member 107. The guided protrusions 504 are projected outwardly in the widthwise direction from the upper end of the right end portion in FIG. 10 in the end walls 112 and 114. The guiding channel 502 constitute an engaging means in the first unit 102, and the guided protrusion 504 constitutes an engaging means in the second unit 104. When the second unit 104 is combined with the first unit 102, the guided protrusion 504 is advanced into the guiding channel 502.

Figure 12:
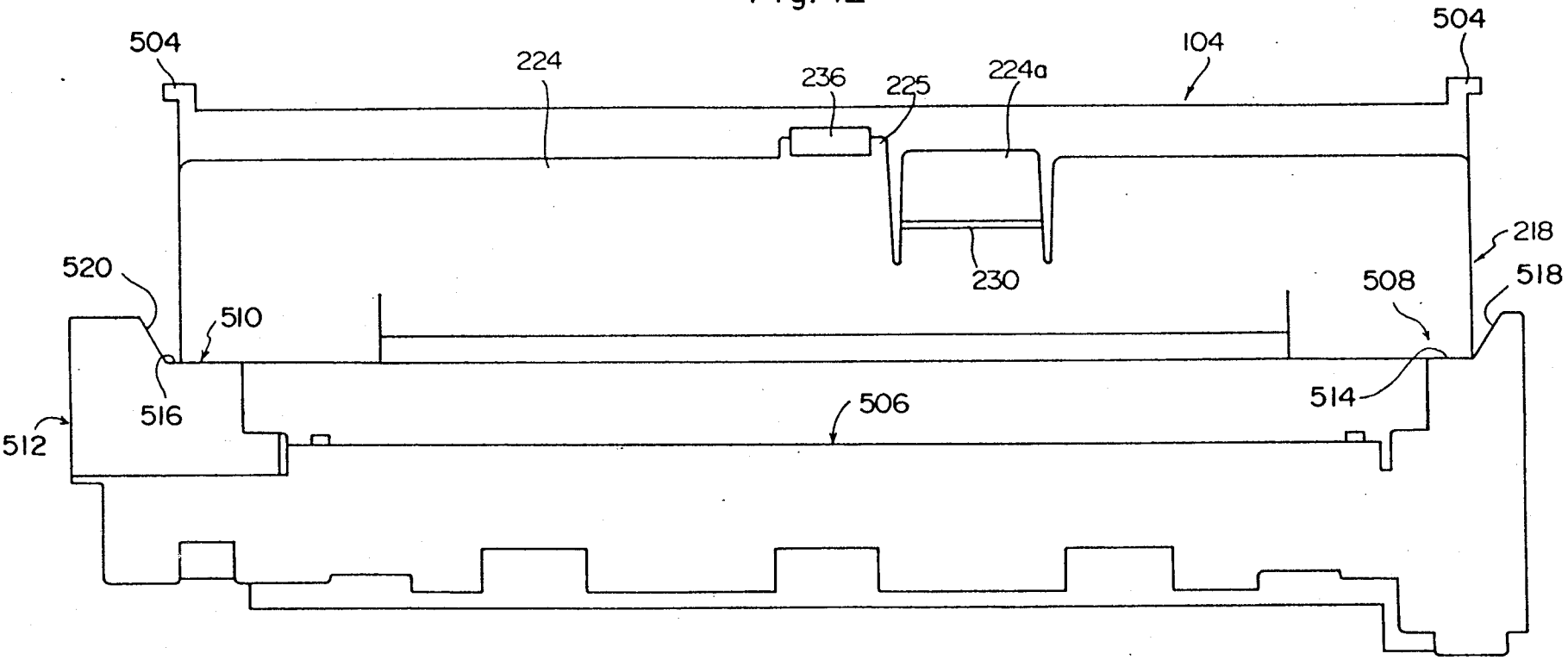
FIG. 12 is a side elevation showing the second unit and a placing stand therefor in the image-forming machine in FIG. 1.

Now, with reference to FIGS. 10 and 12, a pair of placing stands 508 and 510 are formed in a spaced-apart relationship in the widthwise direction on a fixing case 506 covering the fixing roller pair 50 (FIG. 1) disposed within the lower housing 4. One placing stand 508 is defined by the fixing case 506 itself, and the other placing stand 510 is defined by another member 512 fixed to the fixing case 506. Each of the placing stands 508 and 510 has substantially horizontal placing surfaces 514 and 516 and inclined surfaces 518 and 520 extending from the outside edges in the widthwise direction of the placing surfaces 514 and 516 and extending inclinedly outwardly in the widthwise direction upwardly.

When the supporting guiding member 416 is at the elevated position shown in FIG. 10, the first unit 102 is mounted on the supporting guiding member 416. When the supporting-guiding member 416 is held at the elevated position, the second unit 104 is mounted on the first unit 102. When the second unit 104 is mounted, the second unit 104 is first placed on the placing stands 508 and 510. More specifically, as shown in FIGS. 10 and 12, both end portions of the under surface of the cover means 216 mounted on the second unit 104 is positioned on the placing stand 508 and 510, and the second unit 104 is placed on the placing stands 508 and 510. As is clearly shown in FIG. 10, the guided protrusion 504 in the second unit 104 is positioned opposite to the down stream end of the guiding channel 502 in the first unit 102. Then the second unit 104 is moved toward the first unit 102, namely to the right in FIG. 10. As a result, the guided protrusion 504 is advanced from its downstream end of the second unit 104 into the guiding channel 502. As shown by the two-dot chain line in FIG. 10, when the second unit 104 is moved to the right in FIG. 10 until the guided protrusion 504 abuts against the closed downstream end of the guiding channel, the second unit 104 is mounted is required on the first unit 102.

Furthermore, a locking means is provided to lock the first unit 102 and the second unit 104 releasably. With reference to FIGS. 3 and 4, the locking means has a pair of engaging members 522 which are provided in the left end portion in FIG. 4 of the upper wall 110 of the first unit frame 105. The pair of engaging members 522 are arranged opposite to each other and spaced from each other in the width direction (the direction from right bottom to left top in FIG. 4) of the first unit frame 105 and are mounted pivotally via a pin. One end portion of each engaging member 522 projects downwardly of the upper wall 110, and a claw portion 524 is provided in this one end portion. The other end portion of each engaging member 522 projects upwardly of the upper wall 110 and this projecting end portion functions as an operative portion. On the other hand, in correspondence to the provision of the engaging members 522 in the first unit 102, a pair of rectangular openings 526 (FIG. 4) spaced from each other in the width direction (the direction from right bottom to left top in FIG. 4) are formed in the upper wall 116 of the second unit 104. When the second unit 104 has been mounted on the first unit 102, the claw portions 524 of the engaging members 522 project downwardly through the openings 526 formed in the upper wall 116 of the second unit frame 107. By the engagement of these claw portions 524 with those sites of the upper wall 116 which define the openings 526, the first unit 102 and the second unit 104 are locked releasably via the locking means. In correspondence to each engaging member 524, a biasing spring 528 is provided which biases each engaging member 522 toward the opening 526 in the upper wall 116. Accordingly, the biasing springs 528 maintain the claw portions 524 of the engaging members 522 in engagement with the openings 526.

When the second unit 104 is moved as above and mounted on the first unit 102, the upper wall 116 of the second unit 104 interferes with the claw portions 524 of the engaging members 522 to pivot the engaging members 522 against the biasing action of the biasing springs 528. When the biasing action of the second unit 104 is moved to a predetermined position, the engaging members 522 are returned to the original position by the biasing action of the biasing springs 528, the claw portions 524 come into the springs 528 and come into engagement with the springs 528

After the second unit 104 is mounted on the first unit 102 as above, the cover means 216 is detached from the second unit 104. Then, the upper housing 4 is pivoted to the closed position shown by a solid line in FIG. 1, and the supporting member 404 is pivoted to the closed position shown in FIG. 11. Thus, the supporting guiding member 416 is, as described above, pivoted to the lowered position shown in FIG. 11, and the process unit 8 composed of the first unit 102 and the second unit 104 is positioned at the actuating position shown in FIG. 1, that is, at the predetermined position within the lower housing 4. If jamming of a sheet material should happen in the transfer mechanism 42 existing below the process unit 8, the upper housing 4 is pivoted to the open position shown by a two-dot chain line in FIG. 1. Thus, when the process unit 8 is moved to the elevated position shown in FIG. 10, a sheet material which has been jammed can be easily taken out.

Figure 13:
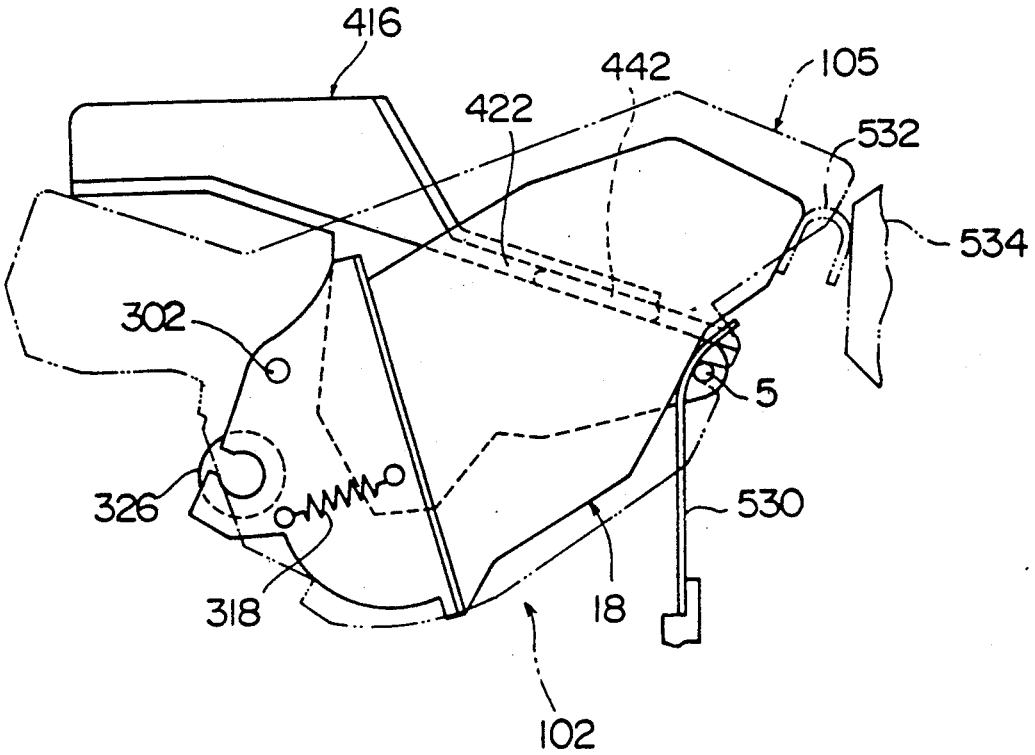
FIGS. 13 and 14 are simplified sectional views showing the process unit and a forcing means acting on the developing device in the image-forming machine in FIG. 1.
Figure 14:
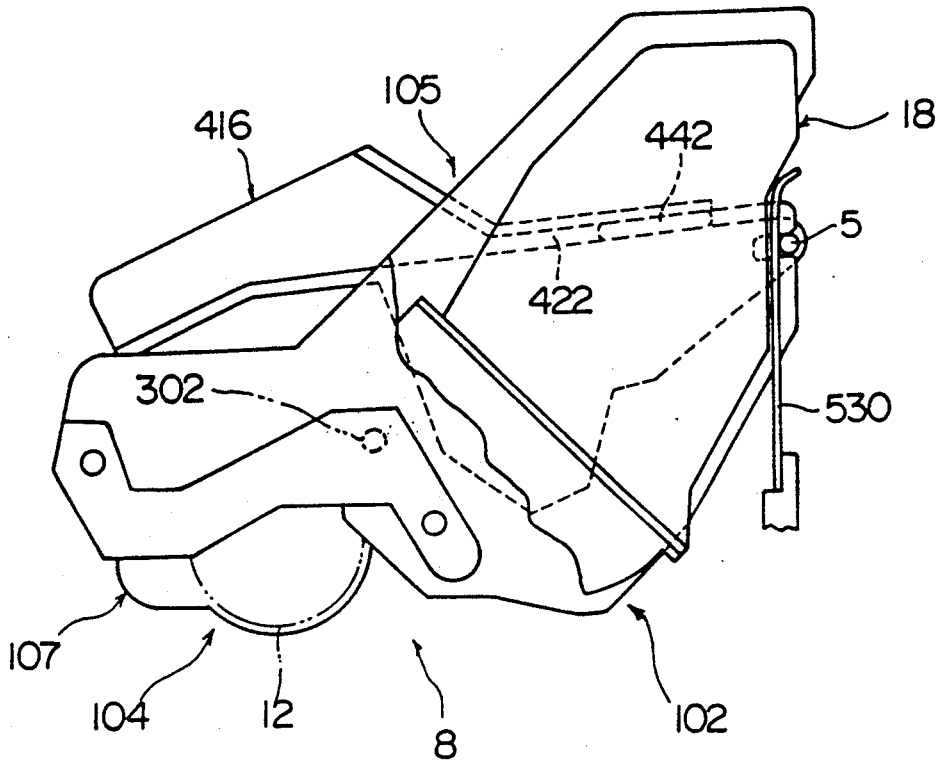

With regard to the mounting of the second unit 104 on the first unit 102, the following improvements are also made in this invention. With reference to FIGS. 13 and 14, a forcing means 530 conveniently formed of a spring member such as a plate spring is disposed at a required position within the lower housing 4. As shown in FIG. 13, when the supporting-guiding member 416 is held at the elevated position, the free end portion of the forced means 530 also acts on the developing device 18 on the first unit 102, the developing device 18 is biased counterclockwise by a predetermined angle about the short rod 302 as a center in FIG. 13 with regard to the unit frame 105 against the elastic biasing action of the extension spring member 318 (FIGS. 4, 8 and 9) disposed in the first unit 102. Accordingly, even when the second unit 104 is mounted on the first unit 102, the interval setting roller 326 (FIGS. 8 and 9) in the developing device 18 is not pressed by the rotating drum 12. In other words, when the first unit 102 is to be mounted on the second unit 104, the second unit 104 does not have to be moved against the elastic biasing action of the extension spring member 318 disposed in the first unit 102, the mounting operation of the second unit 104 with regard to the first unit 102 can be performed easier correspondingly. The biasing angle of the developing device 18 by the forcing means 530 may be to such an extent that some gap is formed between the interval setting roller 326 and the rotating drum 12 in the state in which the second unit 104 is mounted on of the first unit 102 as required. As shown in FIG. 14, when the supporting-guiding member 416 is pivoted to the lowered position and the process unit 8 mounted on it is held at a required actuating position, the forcing means 530 fails to act on the developing device 18. Hence, the interval setting roller 326 of the developing device 18 is elastically biased in a required direction (clockwise direction in FIG. 14) by the elastic biasing action of the extension spring member 318, and is pressed against the rotating drum 12.

Instead of disposing the forcing means 530 at a predetermined position within the lower housing 4, the forcing means 532 which is conveniently formed of a spring member such as a plate spring may be mounted on the developing device 18 as shown by a two-dot chain line in FIG. 13. When the supporting-guiding members 416 is held at the elevated position shown in FIG. 13, the free end portion of the forcing means 532 abuts against a stationary member 534 disposed within the lower housing 4. Thus, by so doing, the developing device 18 is biased by a predetermined angle counterclockwise in FIG. 13 against the elastic biasing action of the extension spring member 318. On the other hand, when the supporting-guiding member 416 is pivoted to the lowered position shown in FIG. 14 and the process unit 8 is positioned at the predetermined actuating position, the free end of the forcing means 532 is isolated from the stationary member 534 and becomes free. Hence, the forcing action of the forcing means 532 is dissolved.

Figure 15:
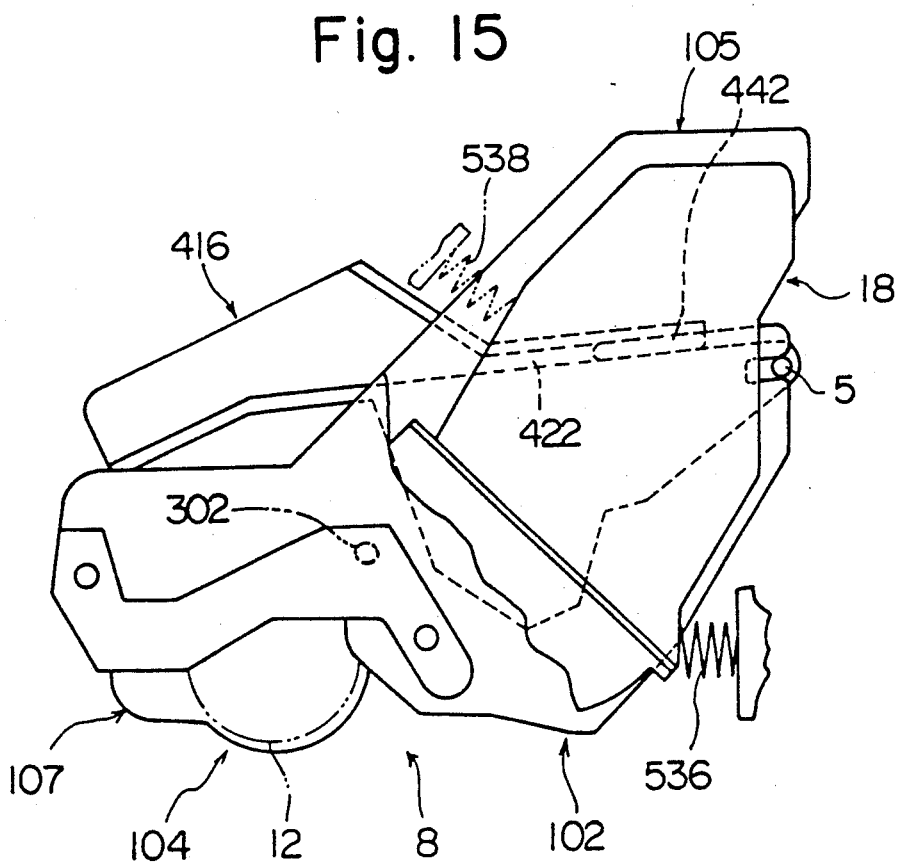
FIG. 15 is a simplified side elevation showing a developing device biasing means which acts on the developing device in the process unit in a modified embodiment.

In a modified example shown in FIG. 15, the extension spring member in the first unit 102 is omitted. At a predetermined position of the lower housing 4, a developing device biasing means 536 which may be a compression coil spring member is disposed. In this modified example, when the second unit 104 is mounted on the first unit 102, the developing device 18 is not biased in any direction in the first unit 102. When the supporting guiding member 416 is pivoted to the lowered position shown in FIG. 15 and the process unit 8 is positioned at the predetermined actuating position, the free end of the developing device biasing means 536 acts on the developing device 18 to elastically bias it clockwise in FIG. 15. Hence, the interval setting roller 326 (FIGS. 8 and 9) in the developing device 18 is depressed to the rotating drum 12. When instead of disposing the developing device biasing means 536 at the required position of the lower housing 4, the development device biasing means 538 which may be a compression coil spring is disposed at the required position of the upper housing 6 as shown by a two-dot chain line in FIG. 15 and the upper housing 6 is pivoted to the closed position, the free end of the developing device biasing means 538 acts on the developing device 18 so that it is elastically biased clockwise in FIG. 15, and thus, the interval setting roller 326 in the developing device 18 is depressed to the rotating drum 12.

While preferred examples of the image-forming machine constructed in accordance with this invention have been described by reference to the accompanying drawings, the present invention shall not be limited to these specific embodiments. It should be understood that without departing from the claims of the invention, various modifications and changes are possible.

What we claim is:

1. An image-forming machine including a main body of the machine having a lower housing and an upper housing mounted on the lower housing for free pivoting between an open position and a closed position and a process unit mounted detachably on the lower housing of the main body; wherein the lower housing of the main body of the image-forming machine has provided therein a supporting-guiding means mounted movably between an elevated position and a lowered position, a holding means mounted movably between a holding position at which the supporting-guiding means is held at the elevated position and a release position at which the supporting-guiding means is permitted to move to the lowered position, and a biasing means for biasing the holding means to said holding position, and when the supporting-guiding means is positioned at the elevated position, the process unit may be mounted on and detached from the supporting-guiding means, and when the supporting-guiding means is positioned at the lowered position, the process unit mounted on the supporting-guiding means, the process unit is held at a predetermined action site, the upper housing of the main body of the machine has provided therein a forced moving means which while the upper housing is pivoted from the open position to the closed position, acts on the holding means, and against the biasing action of the biasing means, moves the holding means from the holding position to the release position.

2. The image-forming machine of claim 1 in which the supporting-guiding means is composed of a pair of supporting-guiding members disposed at intervals in the width direction, the holding means is composed of a pair of holding members disposed correspondingly to the supporting-guiding member, and the biasing means is composed of a pair of spring members disposed in relation to each of the holding members.

3. The image-forming machine of claim 2 in which each of the supporting-guiding members is free to pivot between the elevated position and the lowered position, and each of the holding members is free to pivot between the holding position and the release position.

4. The image-forming machine of claim 1 in which between the upper housing and the supporting-guiding means is interposed an interlocking means which when the upper housing is pivoted from the closed position to the open position, follows it and is moved from the lowered position to the elevated position.

5. The image-forming machine of claim 4 in which the interlocking means is composed of a flexible wire one end of which is fixed to the upper housing and the other end of which is fixed to the supporting-guiding means.

6. The image-forming machine of claim 4 in which an elastic biasing means is disposed between the lower housing and the upper housing for elastically biasing the upper housing at the open position.

7. The image-forming machine of claim 6 in which the elastic biasing means is composed of a spring member which is disposed so as to elastically bias the upper housing at the open position when the upper housing begins to pivot the upper housing from the closed position toward the open position.

8. The image-forming machine of claim 1 in which the process unit is composed of a first unit and a second unit separably combined, the first unit can be mounted on and detached from the supporting-guiding means, a first engaging means is disposed in the first unit, a second engaging means is disposed in the second unit, and by combining the second engaging means with the first engaging means, the second unit can be combined with the first unit; a placing stand for the second unit is disposed in the lower housing, when the supporting-guiding means is held in the elevated position and the first unit is mounted on the supporting-guiding means, and when in this state, the second unit is placed on the placing stand, the second engaging means is positioned in a specified relationship with respect to the first engaging means, and by moving the second unit toward the first unit, the first engaging means can be engaged with the second engaging means.

9. The image-forming machine of claim 8 in which the first engaging means is a pair of guiding channels disposed spacedly in the width direction, the second engaging means is guided protrusions disposed at intervals in the width direction, when the supporting-guiding means is positioned at the elevated position and the first unit is mounted on the supporting-guiding means, and in this state, the second unit is placed on the placing stand, each of the guided protrusions is positioned in proximity to each of the inlets of the guide channels.

10. The image-forming machine of claim 1 in which the process unit is constructed of a first unit and a second unit, the first unit includes a first frame member which can be mounted on and detached from the supporting-guiding means, a developing device mounted on the first frame movably over a predetermined range and a development device biasing means for elastically biasing the developing device in a predetermined direction, the second unit comprises a second frame member separably combined with the first frame member of the first unit, a rotating drum rotatably mounted on the second frame member and having a photosensitive member disposed on the surface, and further a forcing means is disposed which when the supporting-guiding means mounted on the first unit is at the elevated position, forces the developing device opposite to the predetermined direction against the elastic biasing action of the development device biasing means, and when the first unit is mounted on the supporting-guiding means at the elevated position and the second unit is combined with the first unit, the developing device is isolated from the rotating drum by a forcing action of the forcing means, but when the supporting-guiding means is moved to the lowered position from the elevated position, the forcing means fails to act on the developing device, and by the biasing action of the development device biasing means, a predetermined site of the developing device is elastically pressed by a predetermined site of the second unit, and thereby the developing device and the rotating drum are positioned in a prede&ermined relationship.

11. The image-forming machine of claim 10 in which the forcing means is composed of a spring member which is mounted on the lower housing and is kept in contact with the developing device.

12. The image-forming machine of claim 10 in which the forcing means is composed of a spring member which is mounted on the developing device and is kept in contact with the lower housing.

13. The image-forming machine of claim 10 in which a pair of interval setting rollers are mounted rotatably on the developing device with a distance in the widthwise direction, and the pair of interval setting rollers are pressed against both sides of the peripheral surface of the rotating drum.

14. The image-forming machine of claim 1 in which the process unit is constructed of a first unit and a second unit which are separably combined, the first unit comprises a first frame member which can be mounted on or detached from the supporting-guiding means and a developing device mounted movablY on the first frame member over a predetermined range, the second unit includes a second frame member separably combined with the first frame member of the first unit, and a rotating drum mounted rotatably on the second frame member and having a photosensitive member disposed on the surface, and further the lower housing having disposed therein a development device biasing means which when the supporting-guiding means on which the process unit is mounted is moved to the lowered position, acts on the developing device to elastically bias it in a predetermined direction and elastically depress the predetermined site of the developing device to the predetermined site of the second unit and thereby the developing device and the rotating drum are positioned in a predetermined relationship.

15. The image-forming machine of claim 14 in which the development device biasing means is composed of a spring member mounted on the lower housing.

16. The image-forming device of claim 14 in which a pair of interval setting rollers are rotatably mounted on the developing device with widthwise spacing therebetween and the pair of interval setting rollers are pressed against both sides of the peripheral surface of the rotating drum.

17. The image-forming device of claim 1 in which the process unit is constructed of a first unit and a second unit combined separably, the first unit comprises a first frame member which can be mounted on and detached from the supporting-guiding means and a developing device mounted on the first frame member movably over a predetermined range, the second unit includes a second frame member separably combined with the first frame member of the first unit, and a rotating drum rotatably mounted on the second frame member with a photosensitive member disposed on the surface, and further the upper housing having disposed therein a development device biasing means, which when the supporting-guiding means on which the process unit is amounted is moved to the lowered position and the upper housing is pivoted to the closed position, acts on the development device to bias it elastically in a predetermined direction and elastically depress the predetermined site of the developing device to the predetermined site of the second unit and thereby position the developing device in a predetermined relation with respect to the rotating drum.

18. The image-forming machine of claim 17 in which the development device biasing means is composed of a spring member mounted on the upper housing.

19. The image-forming machine of claim 17 in which a pair of interval setting rollers are rotatably mounted on the developing device in spaced-apart relationship in the widthwise direction, and the pair of interval setting rollers are pressed against both sides of peripheral surfaces of the rotating drum.

20. The image-forming machine of claim 1 in which the process unit is constructed by a first unit and a second unit combined separably, the first unit comprises a first frame member and a developing device mounted movably to the first frame member so that it can move over a predetermined range, the second unit comprises a second frame member separably combined on the first frame member of the first unit and a rotating drum mounted rotatably on the second frame member with a photosensitive member disposed on the surface, the first unit further comprising a spring engaging member which is mounted on the first frame member movably between a spring mounting position and an actuating position and can be fixed at the actuating position, and an extension spring member disposed between the spring engaging member and the developing device, and when the engaging member is pivoted to the actuating position from the spring mounting position, the distance between the engaging site of the spring engaging member and the spring engaging site of the developing device becomes long, and the extension spring member elastically biases the developing device to depress a predetermined site of the developing device elastically against the predetermined site of the second unit.

21. The image-forming machine of claim 20 in which when the spring engaging member is positioned at the spring mounting position, the distance between the spring engaging site of the spring engaging member and the spring engaging site of the developing device corresponds to the free length of the tensile spring.

22. The image-forming machine of claim 20 in which the engaging site is formed at one end portion of the spring engaging member, the spring engaging site is positioned inwardly of the first frame member, and the other end portion of the spring engaging member is located outwardly of the first frame member.

23. The image-forming machine of claim 20 in which the spring engaging member is mounted pivotably between the spring mounting position and the actuating position.

24. The image-forming machine of claim 20 in which a pair of interval setting rollers are mounted rotatably with a spaced relationship in the widthwise direction in the developing device, and the pair of interval setting rollers are depressed against both side portions of the peripheral surface of the rota&ing drum.

25. An image-forming machine including a main body of the machine having a lower housing and an upper housing mounted on the lower housing for free pivoting between an open position and a closed position and a process unit mounted detachably on the lower housing of the main body; wherein the lower housing of the main body of the machine has disposed therein a supporting-guiding means mounted movably between an elevated position and a lowered position, when the supporting-guiding means is held on the elevated position, the process unit can be mounted on and detached from the supporting-guiding means, and when the supporting-guiding means is held at the lowered position, the process unit mounted on the supporting-guiding means is held at a predetermined actuation position, and between the upper housing and the supporting-guiding means is interposed an interlocking means which when the upper housing is pivoted from the closed position to the open position, incidentally moves the supporting-guiding means from the lowered position to the elevated position.

26. The image-forming machine of claim 25 in which the lower housing of the main body of the machine further has disposed therein a holding means mounted movably between a holding position at which the supporting-guiding means is held at an elevated position and a release position at which the supporting-guiding means is permitted to move to the lowered position, and a biasing means for biasing the holding means at the holding position.

27. The image-forming machine of claim 26 in which the supporting-guiding means is constructed by a pair of supporting-guiding members disposed with a space in the widthwise direction, the holding means is constructed of a pair of holding members disposed correspondingly to each of the supporting-guiding members, and the biasing means is constructed of a pair of spring members disposed in relation to each of the holding means.

28. The image-forming machine of claim 27 in which each of the supporting-guiding means is free to pivot between the elevated position and the lowered position, and each of the holding means is free to pivot between the holding position and the release position.

29. The image-forming machine of claim 25 in which the interlocking means is composed of a flexible wire one end of which is fixed to the upper housing and the other end of which is fixed to the supporting-guiding means.

30. The image-forming machine of claim 25 in which an elastic biasing means for elastically biasing the upper housing at the open position is disposed between the lower housing and the upper housing.

31. The image-forming machine of claim 30 in which the elastic biasing means is composed of a spring member disposed so as to bias the upper housing at the open position when the upper housing begins to pivot from the closed position toward the open position.

32. An image-forming machine comprising a main body and a process unit mounted detachably on the main body, wherein the process unit is composed of a first unit and a second unit separably combined with each other, a first engaging means is disposed in the first unit, a second engaging means is disposed in the second unit, and by combining the second engaging means with the first engaging means, the second unit can be combined with the first unit, the main body of the machine has disposed therein a supporting-guiding means movably mounted between an elevated position and a lowered position, when the supporting-guiding means is positioned in the elevated position, the first unit can be mounted on and detached from the supporting-guiding means, and when the supporting-guiding means is held at the lowered position, the first unit mounted on the supporting-guiding means is positioned at a predetermined actuating position, and the main body of the machine has further disposed therein a placing stand for the second unit, and when the second unit is mounted on the placing stand while the supporting-guiding means is held at the elevated position and the first unit is mounted on the supporting-guiding means, the second engaging means is positioned in a predetermined relationship with respect to the first engaging means, and by moving the second unit toward the first unit, the first engaging means comes into engagement with the second engaging means.

33. The image-forming machine of claim 32 in which the main body of the machine has a lower housing and an upper housing mounted on the lower housing for free pivoting between an open position and a closed position, and the supporting-guiding means and the placing stand are disposed on the lower housing.

34. The image-forming machine of claim 32 in which the first engaging means is a pair of guiding channels disposed with a space therebetween in the widthwise direction, the second engaging means are guided protrusions disposed with a space therebetween in the widthwise direction, and when the supporting-guiding means is held at the elevated position and while the first unit is mounted on the supporting-guiding means, the second unit is placed on the placing stand, each of the guided protrusions is positioned in proximity to each of the inlets of the guiding channels.

35. An image-forming machine comprising a main body of the machine and a process unit detachably mounted on the main body, wherein the main body has mounted therein a supporting-guiding means mounted movably between an elevated position and a lowered position, the process unit is comprised of a first unit and a second unit separably combined with each other, the first unit comprises a first frame member which can be mounted on and detached from the supporting-guiding means when the supporting-guiding means is at the elevated position, a developing device mounted on the first frame member movably over a predetermined range, and a development device biasing means for elastically biasing the developing device in a predetermined direction, and the second unit includes a second frame member separably combined with the first frame member of the first unit and a rotating drum mounted rotatably on the second frame member with a photosensitive member disposed on the surface, and further, a forcing means is provided which forces the developing device to move against the elastic biasing action of the development device biasing means in a reverse direction to the predetermined direction of the developing device when the supporting-guiding means mounted on the first unit is at the elevated position, when the first unit is mounted on the supporting-guiding means at the elevated position and the second unit is combined with the first unit, the developing device is isolated from the rotating drum by the forcing action of the forcing means, but when the supporting-guiding means is moved to the lowered position from the elevated position, the forcing means no longer acts on the developing device, and by the biasing action of the development device biasing means, a predetermined site of the developing device is elastically depressed to a predetermined site of the second unit, whereby the developing device and the rotating drum are positioned in a prede&ermined relationship.

36. The image-forming machine of claim 35 in which the main body of the machine has a lower housing and an upper housing mounted pivotably between an open position and a closed position, and the supporting-guiding means is disposed on the lower housing.

37. The image-forming machine of claim 36 in which the forcing means is mounted on the lower housing, and is composed of a spring member which comes into abutment with the developing device.

38. The image-forming machine of claim 36 in which the forcing means is composed of a spring member which is mounted on the developing device and comes into abutment with the lower housing.

39. The image-forming machine of claim 35 in which in the developing device, a pair of interval setting rollers are mounted rotatably with a distance therebetween, and the pair of interval setting rollers are depressed to both sides of the peripheral surface of the rotating drum.

40. An image-forming machine comprising a main body of the machine and a process unit mounted detachably on the main body, wherein a supporting-guiding means mounted movably between an elevated position and a lowered position is disposed in the main body of the machine, the process unit is composed of a first unit and a second unit separably combined with each other, the first unit comprises a first frame member which can be mounted on and detached from the supporting-guiding means when the supporting-guiding means is at the elevated position and a developing device mounted on the first frame member movably over a predetermined range, and the second unit comprises a second frame member inseparably combined with the first frame member of the first unit and a rotating drum mounted rotatably on the second frame member with a photosensitive member disposed on the surface, and further, a development device biasing means is disposed which when the supporting-guiding means having the process unit mounted thereon is moved to the lowered position, acts on the developing device and biases it elastically in a predetermined direction and depresses it elastically at a predetermined site of the second unit, whereby the developing device and the rotating drum are positioned in a predetermined relationship.

41. The image-forming machine of claim 40 in which the main body of the machine has a lower housing and an upper housing mounted on the lower housing so as to be free to pivot between an open position and a closed position, and the supporting-guiding means and the developing device biasing means are disposed on the lower housing.

42. The image-forming machine of claim 41 in which the developing device biasing means is comprised of a spring member mounted on the lower housing.

43. The image-forming machine of claim 40 in which the developing device has mounted thereon a pair of interval setting rollers rotatably mounted with a distance in the width direction, and the pair of interval setting rollers are depressed to both sides of the peripheral surface of the rotating drum.

44. An image-forming machine including a main body of the machine having a lower housing and an upper housing mounted on the lower housing so as to be free to pivot between an open position and a closed position, and a process unit mounted detachably on the lower housing of the main body of the machine; wherein the process unit is composed of a first unit and a second unit combined with each other separably, the first unit including a first frame member which can be mounted on and detached from the lower housing and a developing device mounted on the first frame member movably over a predetermined range, and the second unit comprising a second frame member separably combined with the first frame member and a rotating drum mounted rotatably on the second frame member with a photosensitive member disposed on the surface, and further the upper housing has disposed therein a development device biasing means which when the process unit is mounted on a predetermined position of the lower housing and the upper housing is pivoted to the closed position, acts on the developing device to bias it elastically to depress a predetermined site of the developing device against a predetermined site of the second unit and thereby position the developing device and the rotating drum in a predetermined relationship.

45. The image-forming machine of claim 44 in which the lower housing has mounted thereon a supporting-guiding means movably between an elevated position and a lowered position, when the supporting-guiding means is held at the elevated position, the first frame member of the first unit can be mounted on and detached from the supporting-guiding means, and when the supporting-guiding means is held at the lowered position, the process unit mounted on the supporting-guiding means is positioned at the predetermined position of the lower housing.

46. The image-forming machine of claim 44 in which the development device biasing means is composed of a spring member mounted on the upper housing.

47. The image-forming machine of claim 44 in which a pair of interval setting rollers are rotatably mounted on the developing device with an interval in the widthwise direction and the pair of interval setting rollers are depressed against both sides of the peripheral surface of the rotating drum.

48. An image-forming machine including a main body of the machine and a process unit mounted detachably on the mainbody; wherein the process unit is composed of a first unit and a second unit which are separably combined with each other, the first unit including a first frame member and a developing device mounted movably on the first frame member over a predetermined range, and the second unit including a second frame member separably combined with the first frame member of the first unit, and a rotating drum mounted rotatably on the second frame member with a photosensitive member disposed on the surface, the first unit has mounted thereon a spring engaging member which is mounted on the first frame member movably between a spring mounting position and an actuating position and can be fixed at the actuating position, an extension spring member disposed between the spring engaging member and the developing device, when the spring engaging member is pivoted from the spring mounting position to the actuating position, the distance between the spring engaging site of the spring engaging member and the spring engaging site of the developing device becomes longer, whereby the extension spring member elastically biases the development device in a predetermined direction to depress a predetermined site of the developing device elastically against a predetermined site of the second unit.

49. The image-forming machine of claim 48 in which when the spring engaging member is positioned at the spring mounting position, the distance between the spring engaging site of the spring engaging member and the spring engaging site of the developing device is made to correspond to the free length of the extension spring.

50. The image-forming machine of claim 48 in which the spring engaging site is formed in one end portion of the spring engaging member, and the spring engaging site is located inwardly of the first frame member, and the other end portion of the spring engaging member is positioned outwardly of the first frame member.

51. The image-forming machine of claim 48 in which the spring engaging member is mounted pivotally between the spring mounting position and the actuating position.

52. The image-forming machine of claim 48 in which a pair of interval setting rollers are mounted rotatably on the developing device with an interval in the widthwise direction, and the pair of interval setting rollers are depressed against both peripheral surface side portions of the rotating drum.

* * * * *